US005314584A

United States Patent [19]

Grinnell et al.

[11] Patent Number: 5,314,584

[45] Date of Patent: May 24, 1994

[54] FIBROUS PAPER COVER STOCK WITH TEXTURED SURFACE PATTERN AND METHOD OF MANUFACTURING THE SAME

[75] Inventors: Gary C. Grinnell, Northampton, Mass.; Bernard G. Klowak, Neenah; Michael P. Bouchette, Appleton, both of Wis.

[73] Assignee: James River Corporation, Richmond, Va.

[21] Appl. No.: 991,952

[22] Filed: Dec. 17, 1992

Related U.S. Application Data

[60] Division of Ser. No. 693,030, Apr. 30, 1991, Pat. No. 5,223,092, which is a continuation of Ser. No. 479,207, Feb. 19, 1990, abandoned, which is a continuation of Ser. No. 177,785, Apr. 5, 1988, abandoned.

[51] Int. Cl.[5] ..... D21H 27/18

[52] U.S. Cl. ..... 162/109; 162/117; 162/205; 162/362

[58] Field of Search ..... 162/111, 112, 113, 117, 162/109, 204, 197, 205, 362

[56] References Cited

U.S. PATENT DOCUMENTS

| | | | |
|---|---|---|---|
| Re. 28,459 | 7/1975 | Cole et al. | 34/6 |
| 790,023 | 5/1905 | Arkell | 162/111 |
| 1,548,790 | 8/1925 | Lorenz | 162/111 |
| 2,624,245 | 1/1953 | Cluett | 162/100 |
| 3,290,209 | 12/1966 | Ihrman | 162/361 |
| 3,301,746 | 1/1967 | Sanford et al. | 162/305 |
| 3,537,954 | 11/1970 | Justus | 162/306 |
| 3,595,745 | 7/1971 | Cronin | 162/306 |
| 3,821,068 | 6/1974 | Shaw | 162/111 |
| 3,908,071 | 9/1975 | Heim et al. | 162/113 |
| 3,974,025 | 8/1976 | Ayers | 162/113 |
| 3,994,771 | 11/1976 | Morgan, Jr. et al. | 162/113 |
| 4,072,557 | 2/1978 | Schiel | 162/111 |
| 4,208,459 | 6/1980 | Becker et al. | 428/154 |
| 4,309,246 | 1/1982 | Hulit et al. | 162/113 |
| 4,420,372 | 12/1983 | Hostetler | 162/280 |
| 4,440,597 | 4/1984 | Wells et al. | 162/111 |
| 4,469,735 | 9/1984 | Trokhan | 428/154 |
| 4,513,051 | 4/1985 | Lavash | 428/212 |
| 4,528,239 | 7/1985 | Trokhan | 428/247 |
| 4,551,199 | 11/1985 | Weldon | 162/109 |
| 4,637,859 | 1/1987 | Trokhan | 162/109 |
| 4,741,376 | 5/1988 | Landqvist et al. | 162/204 |

FOREIGN PATENT DOCUMENTS

| | | |
|---|---|---|
| 1212473 | 11/1970 | United Kingdom . |
| 1217378 | 12/1970 | United Kingdom . |

*Primary Examiner*—Peter Chin

*Attorney, Agent, or Firm*—Finnegan, Henderson Farabow, Garrett & Dunner

[57] ABSTRACT

A sheet of fibrous web material having one textile-like surface and an opposite substantially smooth surface, a grain depth memory factor greater than 80, an apparent density in the range of about 4 to about 7 pound ream/-caliper point in mils, a caliper (at a basis weight between about 50 and about 75 pounds/3000 square feet) greater than 0.008 inch, and a machine-direction sheet stretch of at least 5%. The invention includes a method of manufacturing the sheet comprising partially dewatering a wet fibrous web to about 30% to about 60% solids, conveying the web to a compression nip defined by a smooth-surfaced roll and a textured-surfaced fabric material, moving the fabric material at a speed of about 15% to about 35% less than the surface speed of the smooth-surfaced roll, compressing the web in the nip with a compression force between about 5 pounds/linear inch and about 100 pounds/linear inch, with an average pressure of between about 20 pounds per square inch and about 400 pounds per square inch in the compression nip, subjecting the fabric material to a tension on opposite sides of the compression nip with the tension on the fabric material entering the nip being greater than the tension on the fabric material exiting the nip, and drying the web.

8 Claims, 35 Drawing Sheets

SHEET SIDE

SHUTE RUNNER

55

MACHINE DIRECTION

FIG. 6A(1)
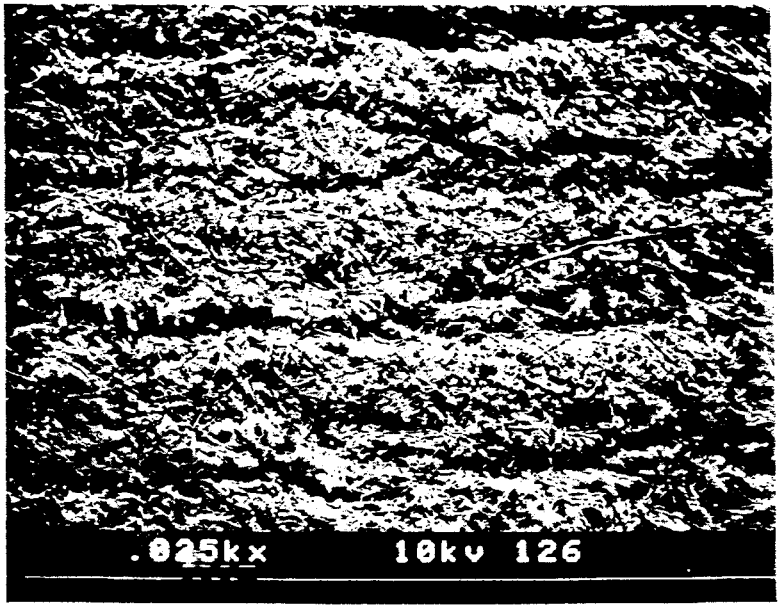
FIG. 6A(2)
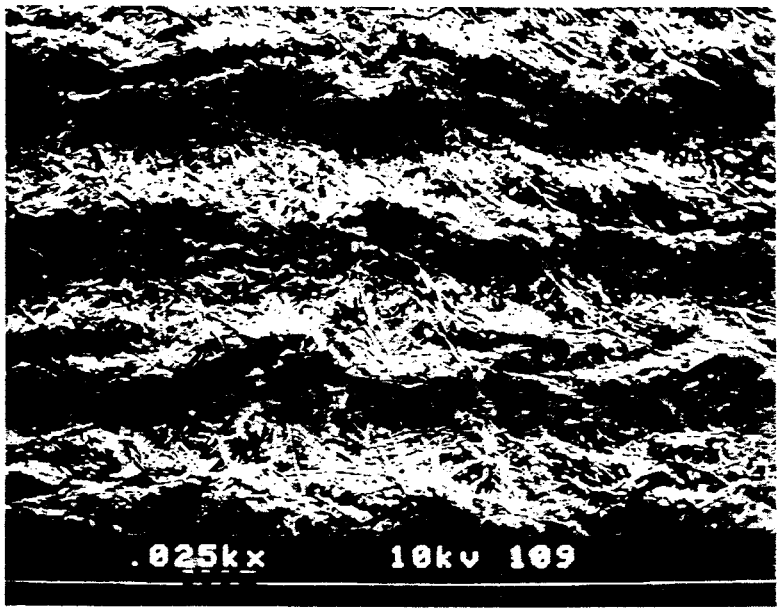

FIG. 6B(1)
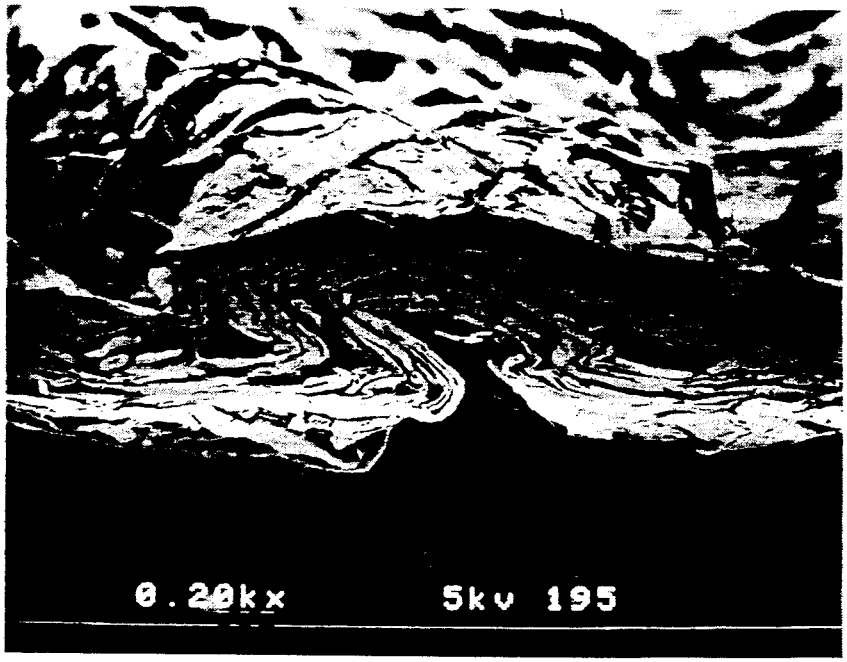
FIG. 6B(2)
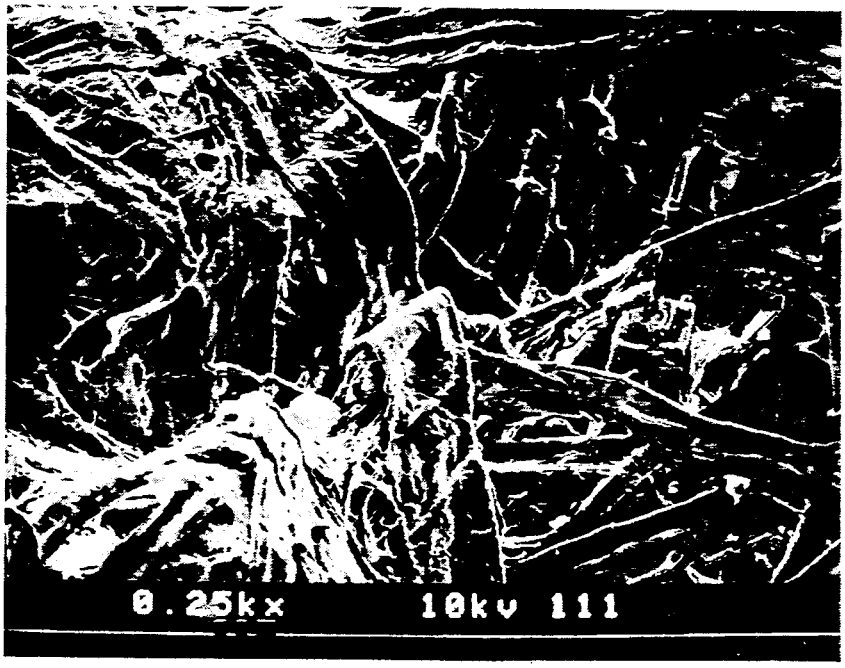

FIG. 7A(1)
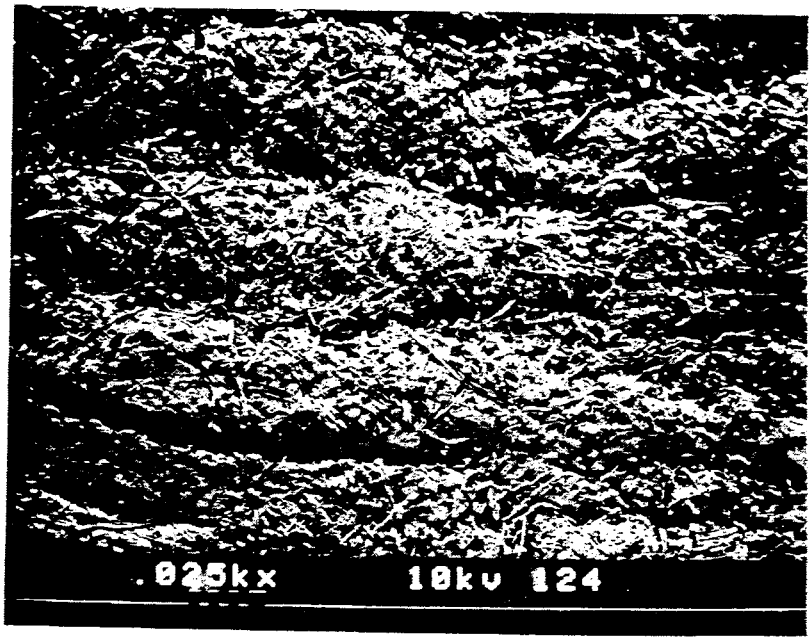
FIG. 7A(2)
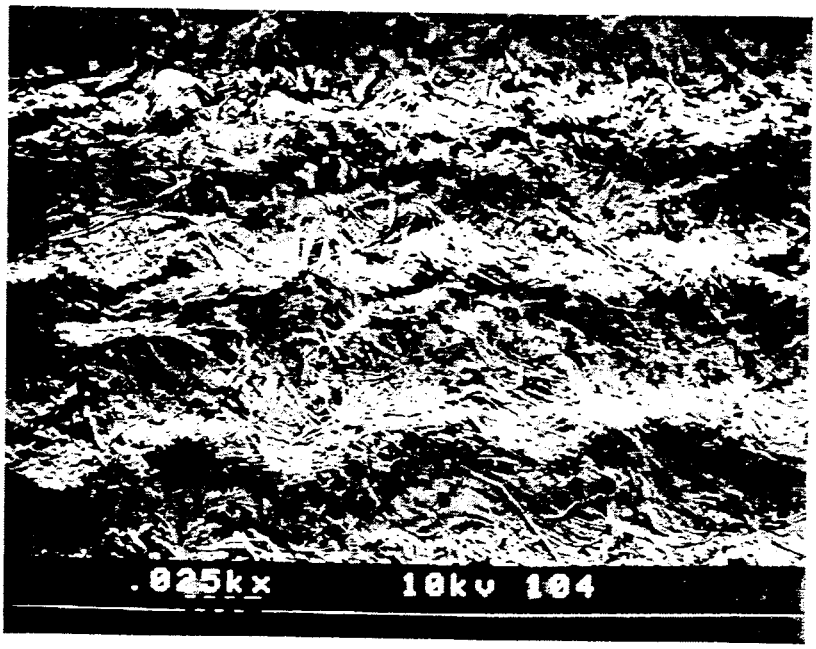

FIG. 7B(1)
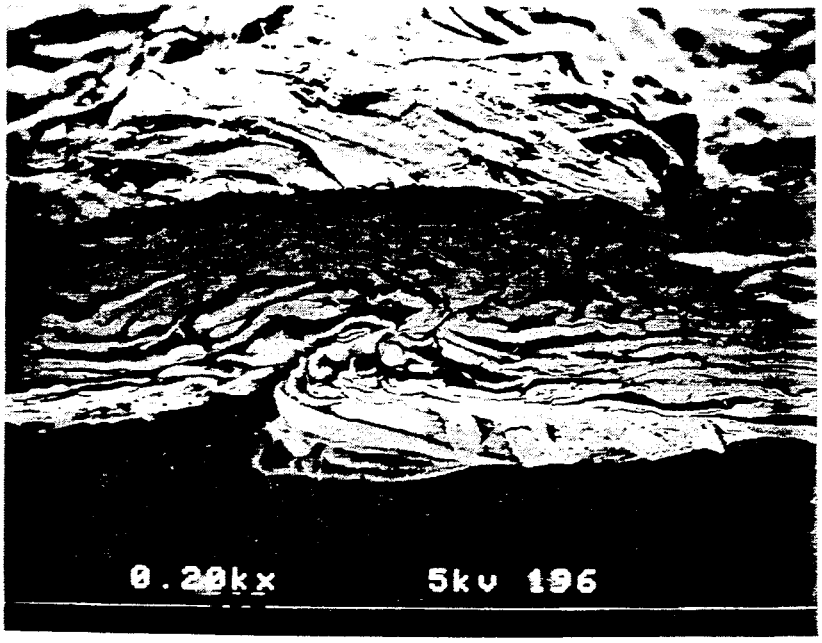
FIG. 7B(2)
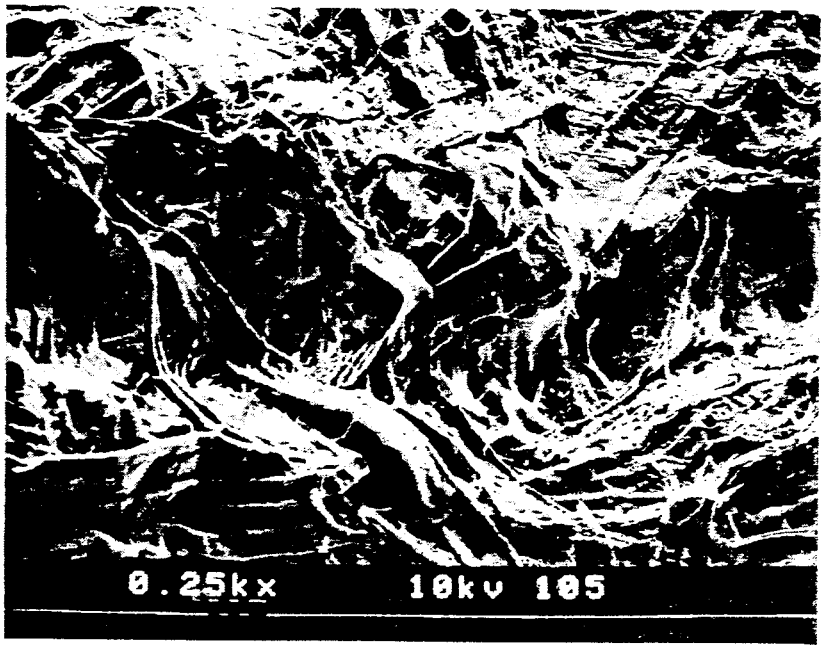

FIG. 8A(1)
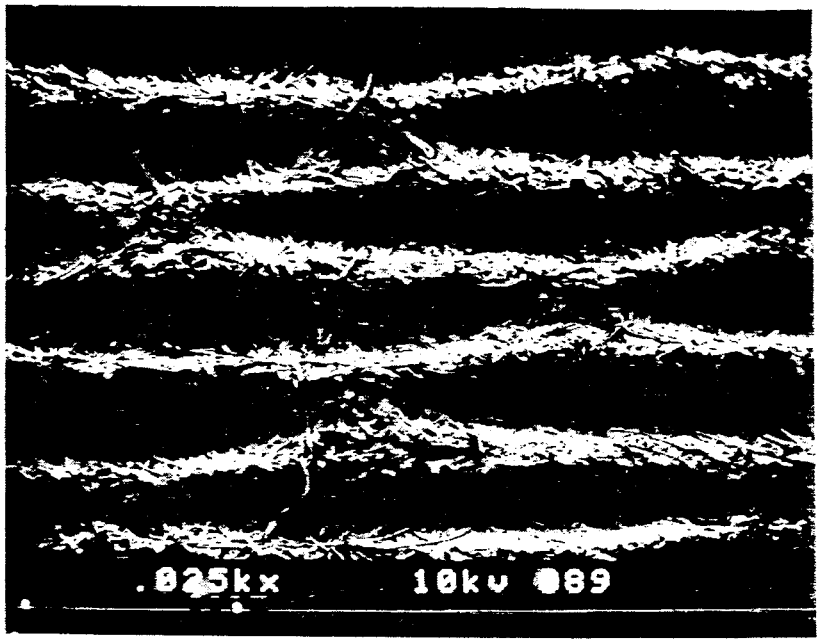
FIG. 8A(2)
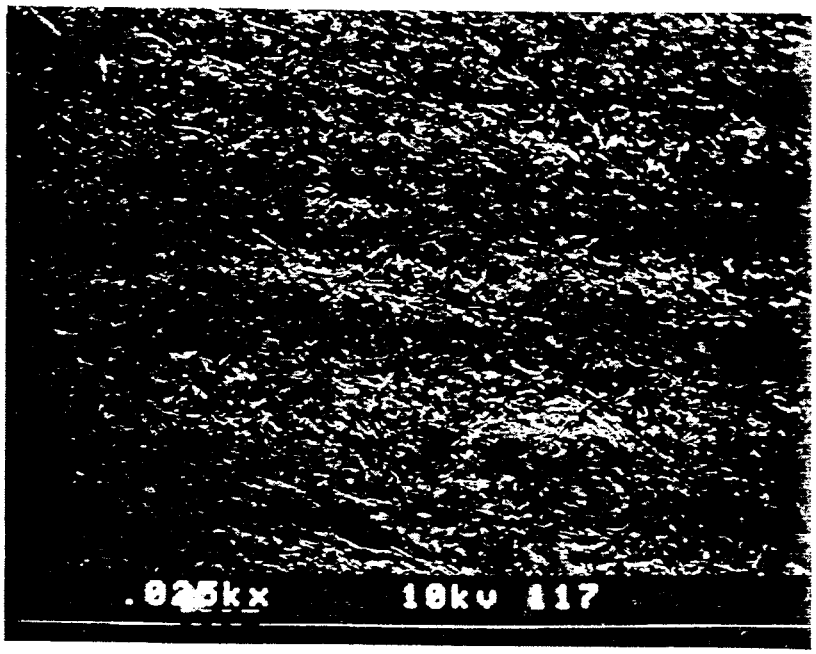

FIG. 8B(1)
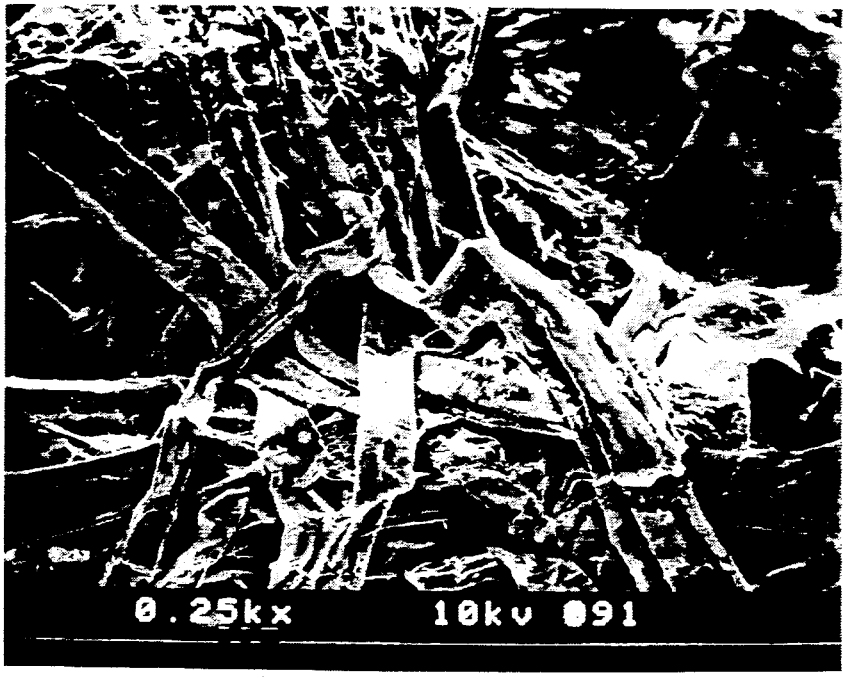
FIG. 8B(2)
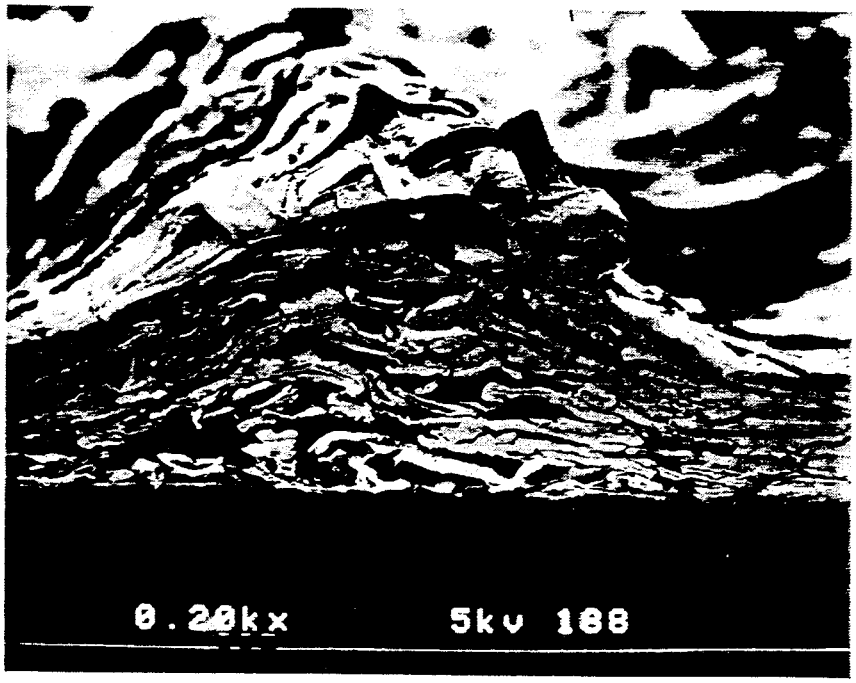

FIG. 9A(1)
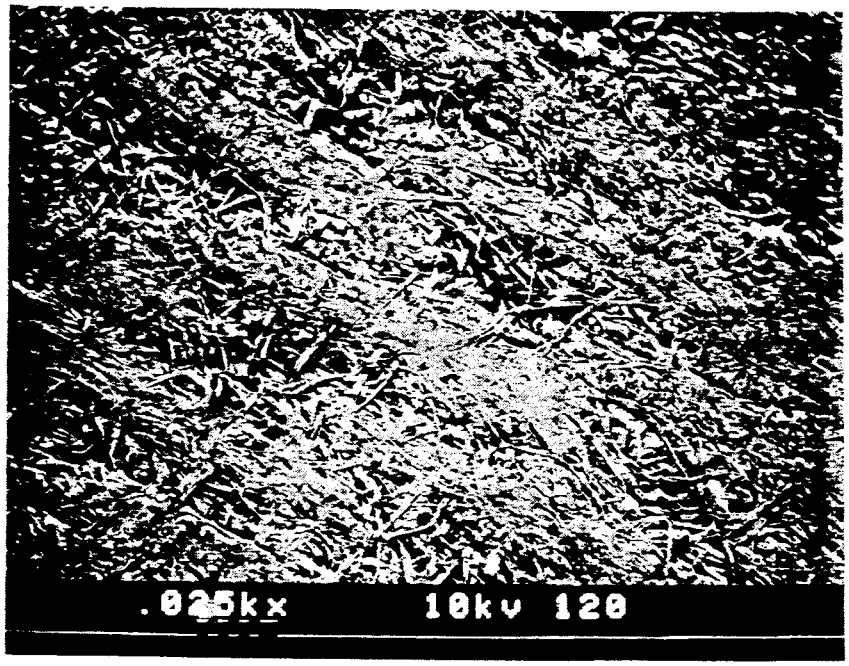
FIG. 9A(2)
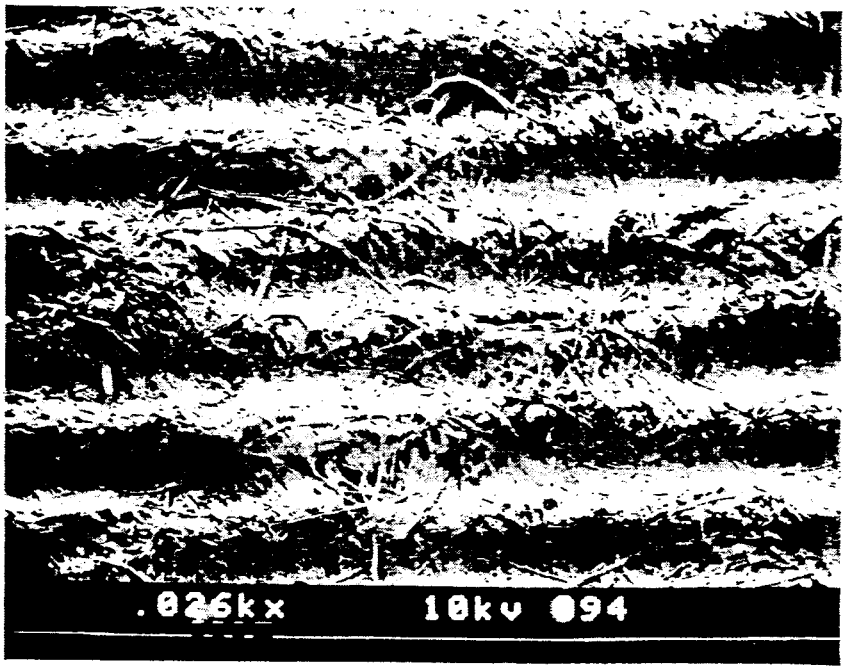

FIG. 9B(1)
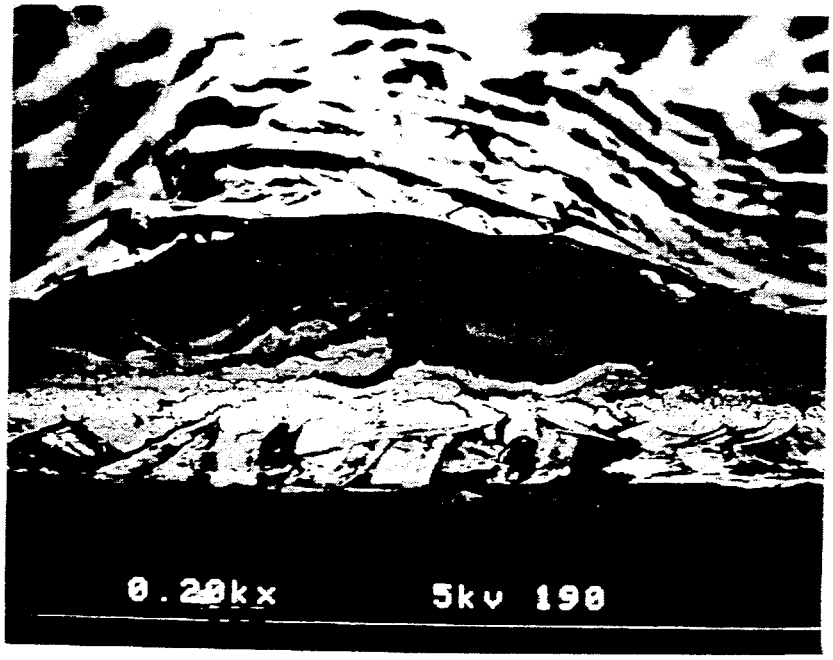
FIG. 9B(2)
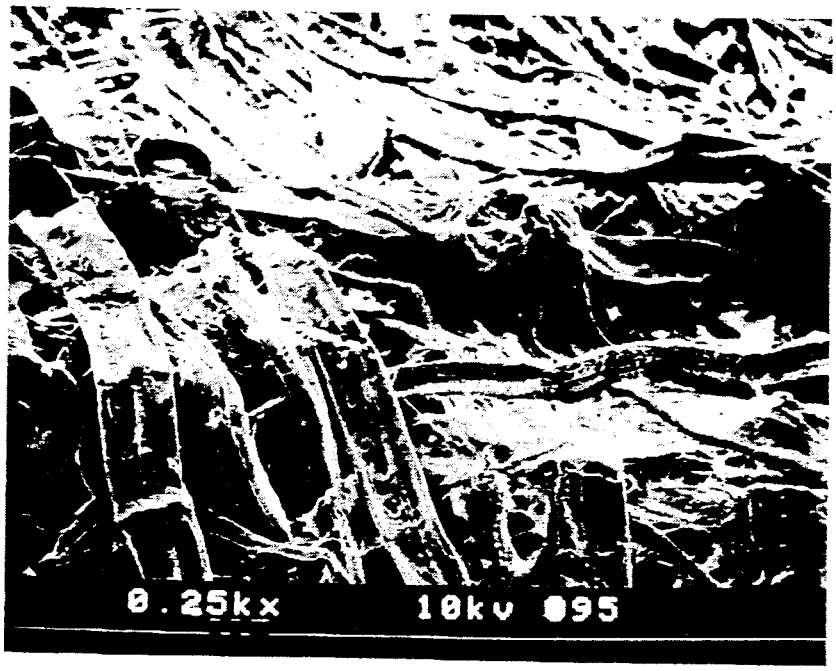

FIG. 10A(1)
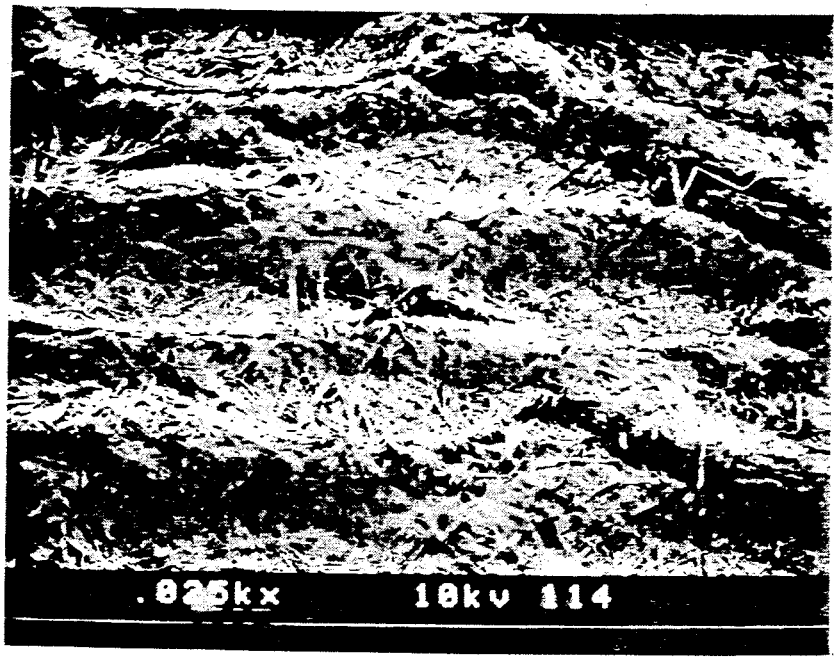
FIG. 10A(2)
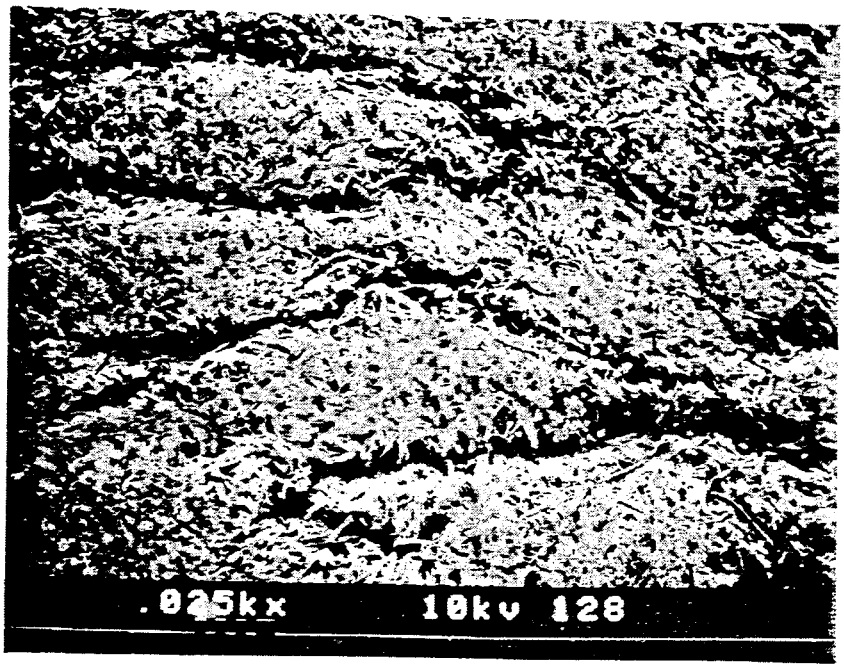

FIG. 10B(1)
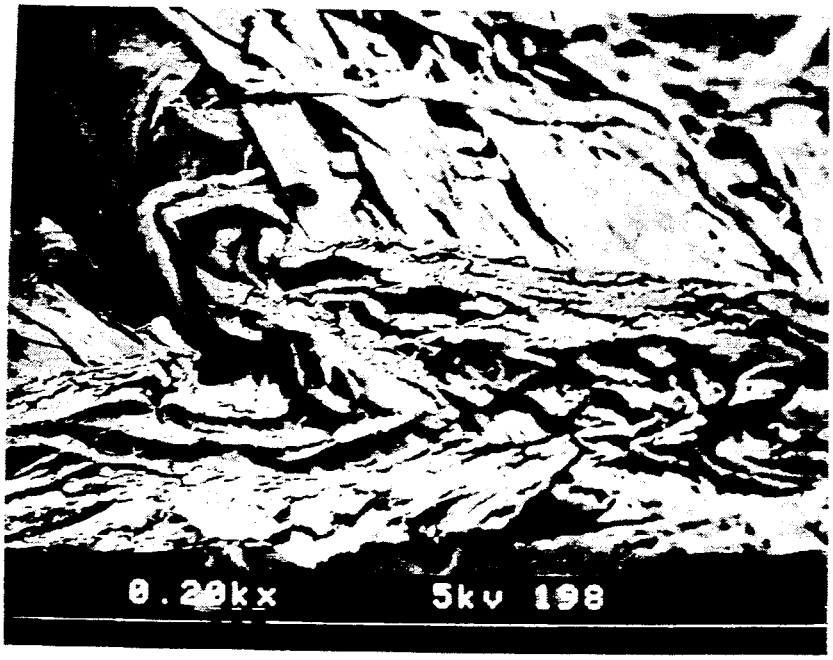
FIG. 10B(2)
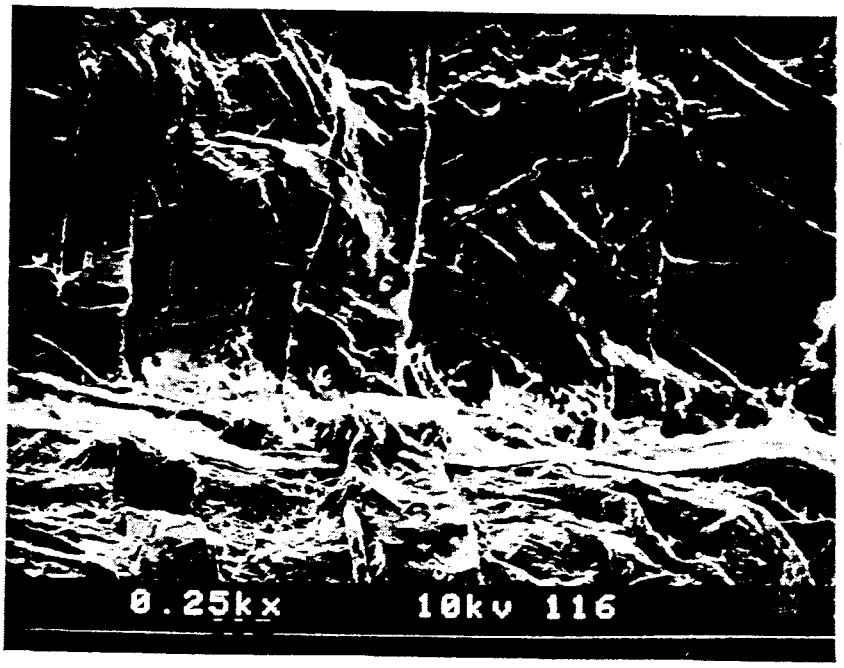

FIG. 11A(1)
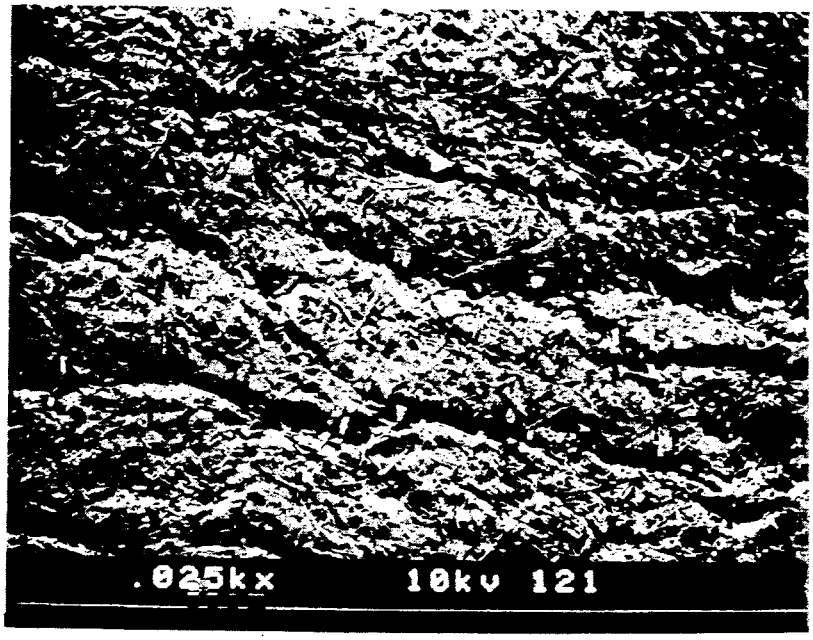
FIG. 11A(2)
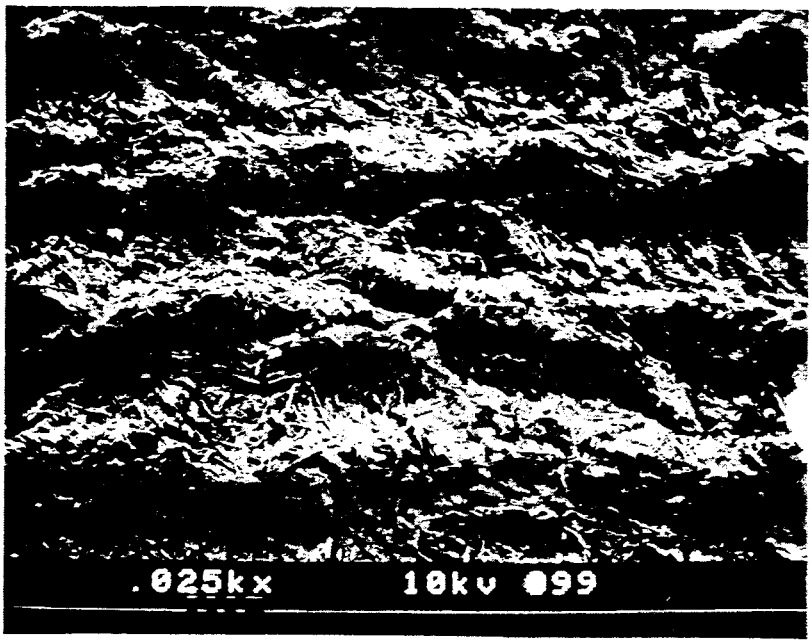

FIG. 11B(1)
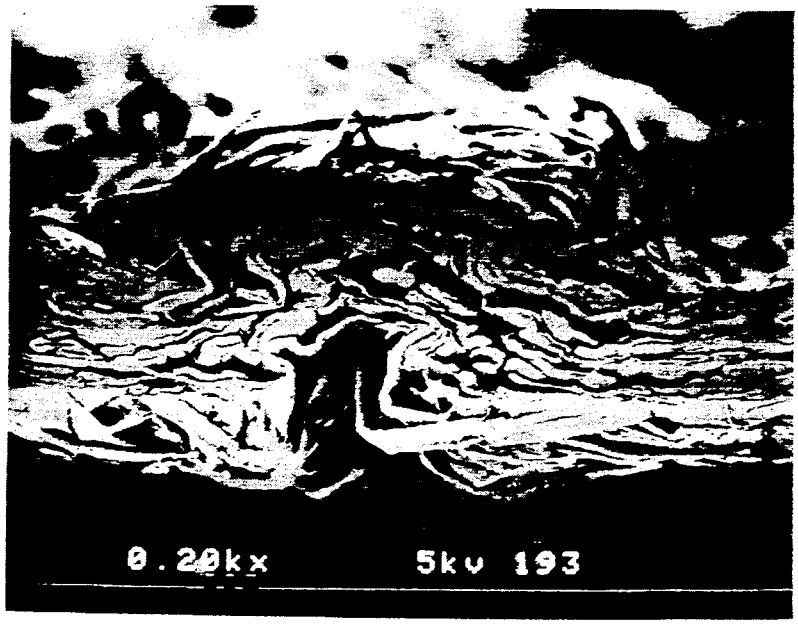
FIG. 11B(2)
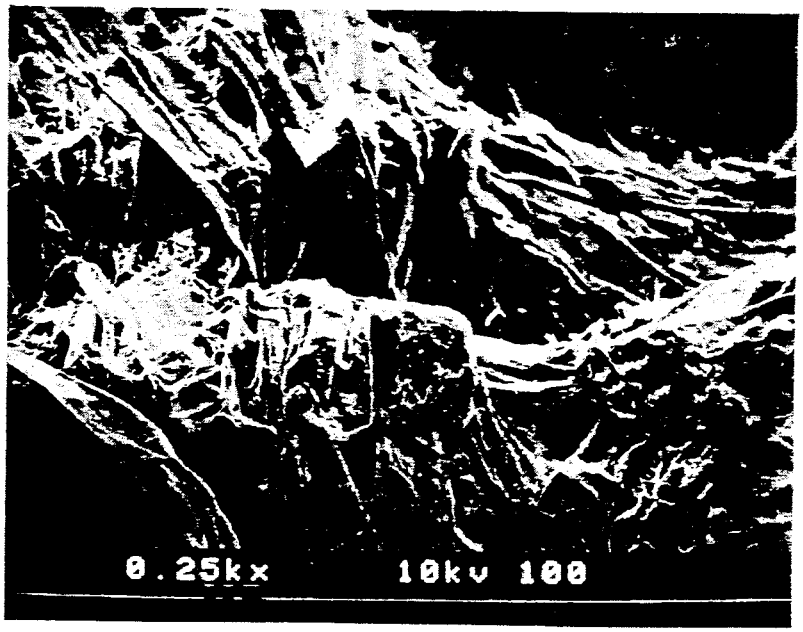

10X

4X

10X

4X

4X

4X

4X

4X

4X

12 X

24 X

FIBROUS PAPER COVER STOCK WITH TEXTURED SURFACE PATTERN AND METHOD OF MANUFACTURING THE SAME

This is a division of application Ser. No. 07/693,030, filed Apr. 30, 1991, now U.S. Pat. No. 5,223,092 which was a continuation of application Ser. No. 07/479,207 filed Feb. 14, 1990 abandoned, which was a continuation of application Ser. No. 07/177,785 filed Apr. 5, 1988.

BACKGROUND OF THE INVENTION

1. Field of the Invention

This invention relates to a fibrous paper cover stock material having a textured surface pattern and a method for manufacturing it.

2. Description of the Related Art

Textured paper cover stocks are conventionally used as covering material in applications such as wall coverings or book covers. In such applications, it is often desirable that the textured paper be identifiable as cloth, leather, or some other textured product. When a textured paper cover stock is successfully substituted for traditional covering materials, significant cost savings results. Paper cover stocks also have the advantage that they can be easily coated with a protective coating that resists moisture and wear. It is frequently difficult to adhere protective coatings to cloth or leather surfaces, and cloth surfaces require a significantly greater quantity of coating per unit area than is the case with paper because cloth has a higher degree of permeability than paper.

A further potential advantage of a paper cover stock over materials like cloth or leather is that the paper cover stock can be manufactured with one textured surface and one smooth surface. The smooth surface can be more easily adhered to flat surfaces like book covers or walls than is the case with traditional covering materials like cloth or leather.

Because of these relative advantages enjoyed by paper cover stock, paper cover stock products having textured surface patterns that resemble cloth or leather have been produced and applied with some success. Such conventional textured cover stock products have been produced by treating finished paper manufactured according to conventional paper making methods. Texturizing of conventionally manufactured paper sheets occurs off-machine, that is, subsequent to the production of the paper itself. According to one conventional texturizing method, paper sheets are subjected to moisture and then run between textured rollers to impart a textured pattern on a surface of the sheets. Alternatively, paper sheets may be run through heated textured rollers to produce a textured pattern on a surface of the sheets. Unfortunately, sheets produced by such off-machine methods are usually readily identifiable as not having the appearance of fabric or leather because it has not been possible to consistently produce a paper product having the undulations and detail necessary to mimic traditional cover material surfaces when off-machine texturizing methods are applied.

In addition, paper products that have been textured off-machine suffer from a "memory effect" when exposed to water vapor or moisture. Upon exposure to water vapor or moisture, conventional off-machine textured sheets tend to return to their original finished state. This memory effect is especially troublesome in bookbinding or wallpapering where aqueous glues are used.

After exposure to water vapor or moisture, paper cover stocks textured off-machine lose much of their surface texture so that any resemblance they may have to traditional cloth or leather covering materials is lost. Thus, the aesthetic value of such products can be radically reduced by moisture.

A further disadvantage of conventional textured cover materials is that off-machine pressing substantially reduces the caliper of a cover stock. Thus, to obtain a desired caliper, it is necessary to use a larger weight of product than would be the case if no off-machine treatment was applied. This can substantially increase the cost of producing a cover stock material of a desired caliper.

Finally, off-machine treatment necessitates additional treatment procedures and equipment. It is preferred that a paper cover stock be in a state ready for sale and shipment at the time it comes off the paper making machine without the need for further time consuming and costly treatment steps.

In the production of bulky paper products, various on-machine treatments have been disclosed. These disclosed on-machine methods are designed to yield bulky products such as paper towels and absorbent tissue. For example, in U.S. Pat. No. 4,102,737 (Morton), a bulky absorbent sheet for use in tissue or toweling is produced when a paper web is predried on a pattered fabric before final drying and creping. As disclosed in Morton, bulky paper sheets are prepared by partially predrying a fibrous web on a drying/imprinting fabric before the web is pressed against the drying/imprinting fabric in a nip formed between a pressure roll and a dryer drum. The nip pressure serves to impress the fabric into the thermally predried paper web. Drying is completed on the dryer drum and creped with a doctor blade upon removal from the drum to obtain greater bulk. Because the web is nearly dry before embossing takes place, a textured pattern capable of mimicking a cloth of leather cover material cannot be achieved by this process.

In U.S. Pat. No. 4,551,199 (Weldon), another process for treating web material is disclosed. According to Weldon, bulking and creping of a paper web is achieved by transporting a web into a differential velocity nip defined by a web support and an open mesh fabric pick-up member having voids therein. The pick-up member has a relative velocity slower than that of the support surface at the nip location. When the web is applied to the fabric pick-up member, the web is impressed into the voids of the fabric to emboss the web. As the web approaches the nip, a deceleration of the web occurs due to the slower moving fabric filaments of the pick-up member causing the web to collapse on itself one or more times to form crepe folds. The succeeding folds in the web press against earlier folds, pushing them into the voids of the fabric. The size and number of folds are determined by the flexibility of the web and the magnitude of the relative velocity differential between the pick-up fabric and the transport member support surface. Sheets produced according to the process disclosed in Weldon have an apparent bulk greater than 0.4 caliper pts/lb ream (that is, an apparent density less than 2.5 lbs ream/caliper pt in mils) which is indicative of folding and bulking much greater than is desirable for cover stock materials.

SUMMARY OF THE INVENTION

Accordingly, it is an object of the present invention to improve upon known methods of manufacturing fibrous web products to produce a paper cover stock with a significantly improved textured surface pattern that closely simulates traditional covering materials such as cloth or leather.

It is another object of the present invention to provide a paper cover stock material having a textured surface pattern that can be produced on a paper making machine without additional off-machine treatment steps.

Another object of the present invention is to provide a paper cover stock material with a textured surface that does not significantly degrade upon exposure to moisture or water vapor.

Yet another object of the invention is to provide a paper cover stock material with a textured surface pattern that has a caliper at a given basis weight that is significantly greater than the caliper of conventional textured cover stock materials of the same weight.

Additional objects and advantages of the present invention may be realized and obtained by means of the instrumentalities and combinations particularly pointed out in the appended claims.

The method of the invention for manufacturing paper cover stock having a textured surface pattern comprises the steps of forming a wet fibrous web, partially dewatering the web to between about 30% and about 60% solids, conveying the partially dewatered web on a smooth-surfaced roll to a compression nip defined by the smooth-surfaced roll and a fabric material having a textured surface pattern, moving the fabric material at a speed of about 10% to about 40% less than the surface speed of the smooth-surfaced roll, compressing the web in the nip by forcing the fabric material against the web on the smooth-surfaced roll to directly transfer the web from the smooth-surfaced roll to the material, the fabric material being compressed against the web with a compression force between about 5 lbs/linear inch and about 100 lbs/linear inch, the average pressure in the compression nip being between about 20 psi and about 400 psi, the fabric imprinting a textured pattern on a surface of the web, the web being further compressed and textured by the difference in speed between the fabric material and the surface of the roll, and drying the web, the dried web having an apparent density greater than about 4 lbs ream of 3000 sq. ft./caliper pt. in mils. Preferably, the fabric has a first textured surface pattern facing the smooth-surfaced roll.

The method may further include the step of applying a vacuum through the fabric material at the compression nip to directly transfer the web from the roll to the fabric material and to generally conform the surface of the web in contact with the fabric material to the textured surface pattern of the material while the surface of the web opposite the fabric material remains substantially smooth.

The apparatus for manufacturing paper cover stock having a textured surface pattern comprises means for forming a wet fibrous web, dewatering means for partially dewatering the web in a first compression nip to between about 30% and about 60% solids, a smooth-surfaced roll having an outer circumferential surface for conveying the dewatered web ate a predetermined speed to a transfer station, a sheet of fabric material having a textured surface pattern for receiving the web at the web transfer station and for conveying the web from the transfer station at a speed less than the predetermined speed, the sheet of fabric material being substantially tangential to a point on the outer circumferential surface of the smooth-surfaced roll at the transfer station, compression means acting with a compression force between about 5 lbs/linear inch and about 100 lbs/linear inch on the web through the sheet of fabric material for transfering the web from the smooth-surfaced roll to the sheet of fabric material, and for compressing the web against the textured surface pattern of the fabric material, and means for drying the web after compression, the dried web having an apparent density greater than 4 lbs ream of 3000 sq. ft./caliper pts.

In the preferred embodiment of the invention, the smooth-surfaced roll defines a second compression nip with a sheet of fabric material at the web transfer station. Preferably, the compression means comprises a back-up roller, the back-up roller abutting a second surface of the sheet of fabric material opposite from the first surface at the second compression nip. The apparatus may further include back-up roller adjusting means for moving the back-up roller toward and away from the smooth-surfaced roll to adjust the compression of the fabric material against the web and smooth-surfaced roll.

The product of the invention is a sheet of paper cover stock material having a textured surface pattern comprising a sheet of fibrous material having first and second surfaces, an apparent density in the range of about 4 to about 7 lb ream of 3000 square feet/caliper pts, and wherein the first surface has a textured surface pattern and the second surface is substantially smooth. That is, although the second surface is flatter and smoother than the first surface and feels relatively smooth to the touch, the second surface does have some indentations (see FIG. 6 and discussion of smoothness tests below). The sheet has a basis weight greater than 25 lbs/3000 square feet, with no known upper limit. Preferably, the sheet has a basis weight between about 50 and about 75 lbs/3000 square feet and the caliper is preferably greater than 0.008 inch. In a preferred embodiment of the invention, sheet stretch in the machine direction is more than two times greater than sheet stretch in the cross direction. It is preferred that the sheet be flexible and have a machine-direction MIT-double-fold rating of at least 1000.

BRIEF DESCRIPTION OF THE DRAWINGS

The accompanying drawings, which are incorporated in and constitute a part of this specification, illustrate the preferred embodiments of the invention and, together with the description, serve to explain the principles of the invention.

FIGS. 6A(1), A(2), B(1), B(2); 7A(1), A(2), B(1), B(2); 8A(1), A(2), B(1), B(2); 9A(1), A(2), B(1), B(2); 10A(1), A(2), B(1), B(2); 11A(1), A(2), B(1), B(2), are microtomes of product samples of the present invention.

Figure 1:
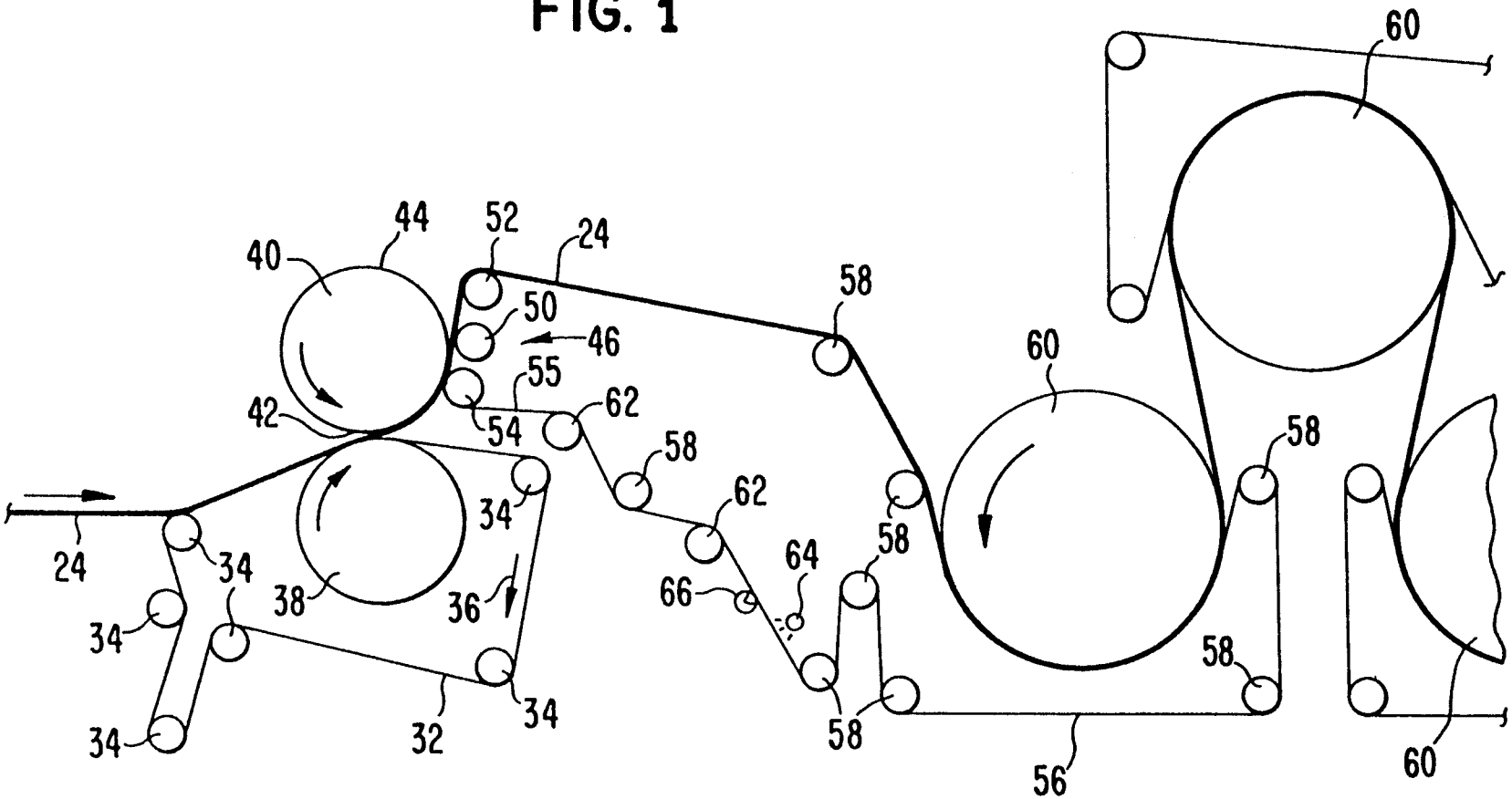
FIG. 1 is a schematic side elevation view of a portion of the apparatus used for forming the wet fibrous web of the invention.

DETAILED DESCRIPTION OF THE PREFERRED EMBODIMENTS OF THE INVENTION, EXAMPLES OF WHICH ARE ILLUSTRATED IN THE ACCOMPANYING DRAWINGS

The Apparatus

The apparatus for manufacturing paper cover stock having a textured surface pattern includes means for forming a wet fibrous web 24 from a supply of fiber furnish in a manner which is well known. Transfer of web 24 from the forming means may be accomplished or assisted by means such as an air knife or vacuum box (not shown), both means being well known.

The fibers in the supply of fiber furnish are preferably wood fibers but may also include other fibers suitable for paper making processes, for example, synthetic wood fibers or high performance carbohydrate fibers such as cotton, sisal, or flax. In some applications, it may be desirable to put additives in the fiber furnish which modify the appearance and physical characteristics of the web or the end product paper produced on the apparatus.

In accordance with the invention, the apparatus includes dewatering means for partially dewatering the web to between about 30% and about 60% solids. As embodied and depicted in FIG. 1, the dewatering means includes felt loop 32 for receiving the wet web 24. Felt loop 32 is supported on a plurality of turning rolls 34 so as to rotate the felt in the direction indicated by arrow 36. Felt loop 32 passes through a first compression nip 42 formed between press roll 38 and smooth-surfaced transfer roll (e.g., a chrome roll) 40. Web 24 also passes through nip 42. In nip 42, web 24 is compressed between the felt on press roll 38 and smooth-surfaced transfer roll 40 so as to dewater web 24 to between about 30% and about 60% solids. Preferably, web 24 is dewatered to about 40% solids. Moisture removed from web 24 at nip 42 is transferred by felt loop 32 and is removed from the felt by a wringer (not shown) or other well known conventional means.

Figure 2:
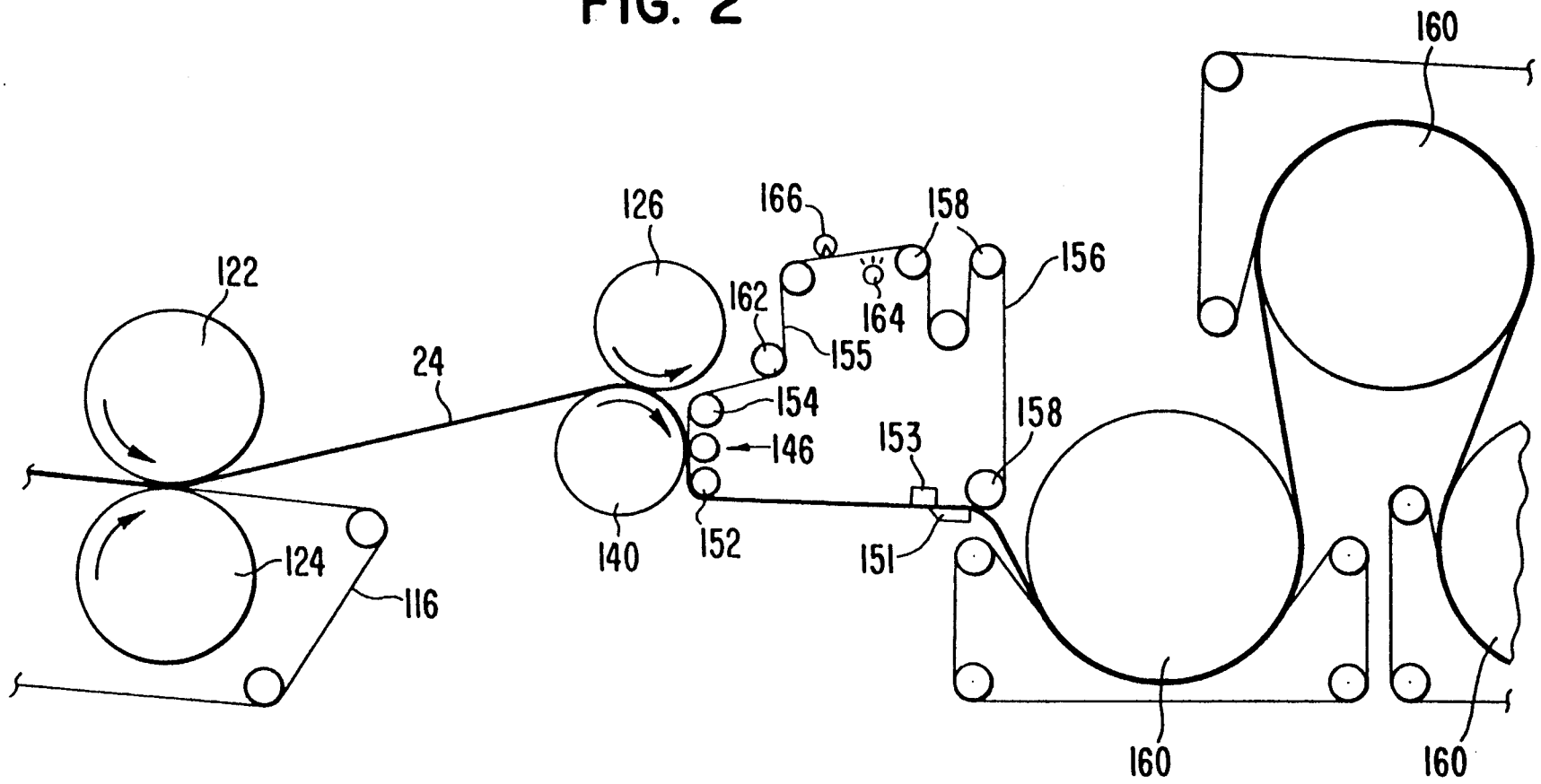
FIG. 2 is a schematic side elevation view of another embodiment of the apparatus used for forming the fibrous web of the invention.

One preferred embodiment of a dewatering means is illustrated in FIG. 2. In this embodiment, web 24 is transferred on a felt or wire loop 116 from a web forming means. Rolls 122 and 124 press the web to dewater it to between 30% and 60% solids. Dewatered web 24 then is drawn between a rubber roll 126 and a smooth-surfaced roll 140 whereby web 24 conforms to the surface of roll 140 to be conveyed by rotation to transfer station 146. The web is self-supported between the dewatering rollers 122, 124 and smooth-surfaced roll 140.

Fabric material 155 is part of a fabric loop 156 mounted on turning rollers 152 and 154 on opposite sides of transfer station 146 and on guide rollers 162. A stretch roller 158 may be employed to maintain a desired tension in fabric loop 156.

The dewatering means may be otherwise embodied as other known felt and roller configurations, as for example disclosed in U.S. patent application Ser. No. 17,220 filed Feb. 20, 1989, which is assigned to a common assignee, and is hereby incorporated by reference for its disclosure of alternative embodiments of web forming and dewatering.

In accordance with the invention, the apparatus includes a smooth-surfaced roll having an outer circumferential surface 44 for conveying the dewatered web 24 to a transfer station 46, as depicted in FIG. 1. Preferably, smooth-surfaced roll 40 is heated to about 150°–210°F. Smooth-surfaced roll 40 is driven at a fixed predetermined speed. Preferably, roller 50 is smaller than smooth-surfaced roll 40. For example, smooth surfaced roller 40 may be 24 inches in diameter, while roller 50 may be 6, 5, or even 2 inches in diameter.

As used herein, the term "smooth-surfaced" refers to a selected range of values of roughness average. The term "roughness average" is defined on page 2392 of the 22d edition of *Machinery's Handbook*, Industrial Press, Inc., New York, N.Y. In tests, roll 40 had a roughness average of about 4 to 6 microinches finish, although the finish of the roll surface could range from about 0.5 to about 125 microinches roughness average. The roughness could be patterned or random in distribution. In tests, smooth-surfaced roll 40 was a chrome-plated steel roll. The composition of surface 44, however, is not limited to metal; it could be polymeric, elastomeric, or natural or inorganic compositions such as are typically used in the paper industry.

Figure 5:
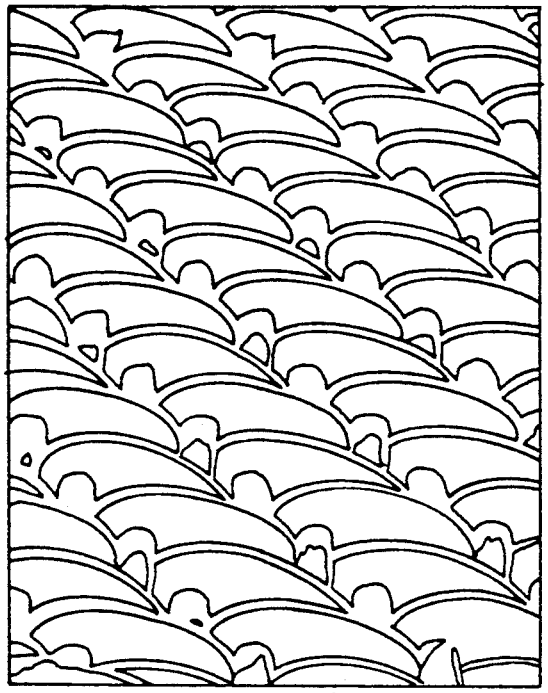
FIG. 5(1) and 5(2) is a schematic view of one examples of the fabric material used in the apparatus shown in FIGS. 1, 3, and 4.
Figure 5:
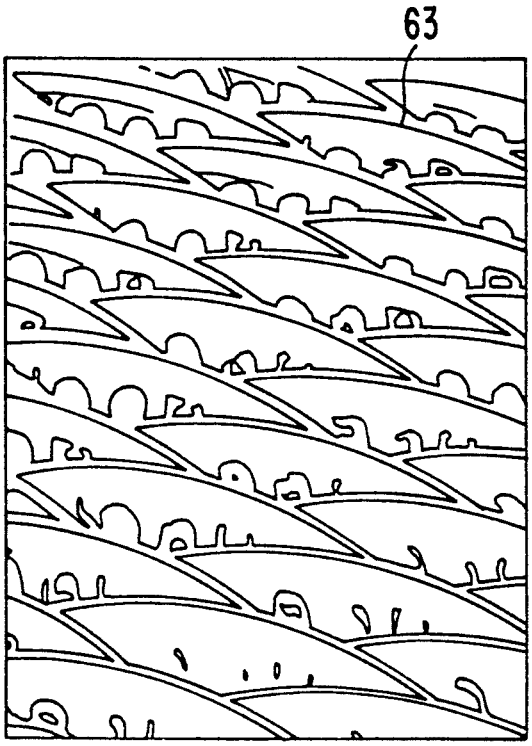
Figure 12A:
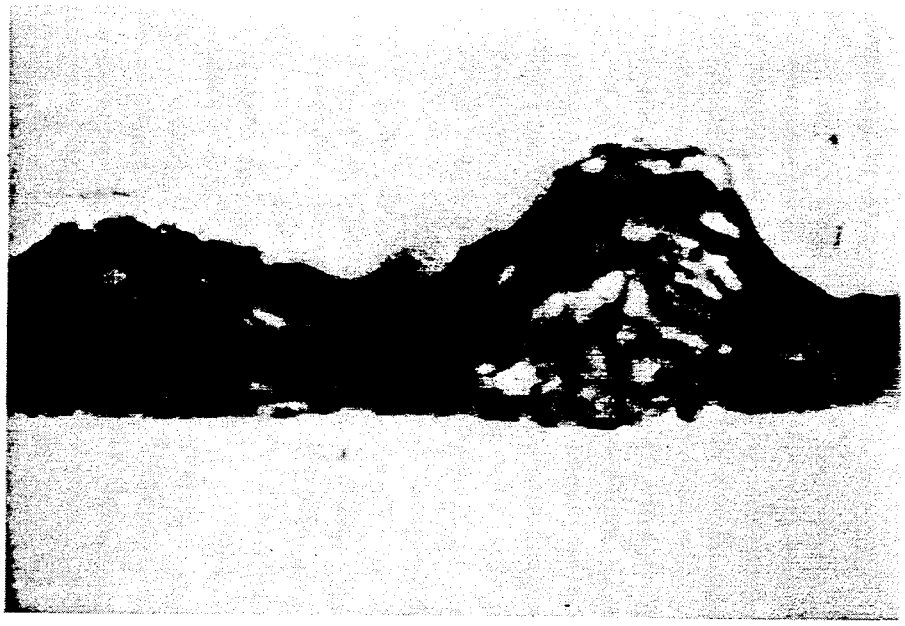
FIGS. 12A, B; 13A, B; 14A, B; 15A, B; 16A, B; 17A, B are microtomes of product samples according to the present invention.
Figure 12B:
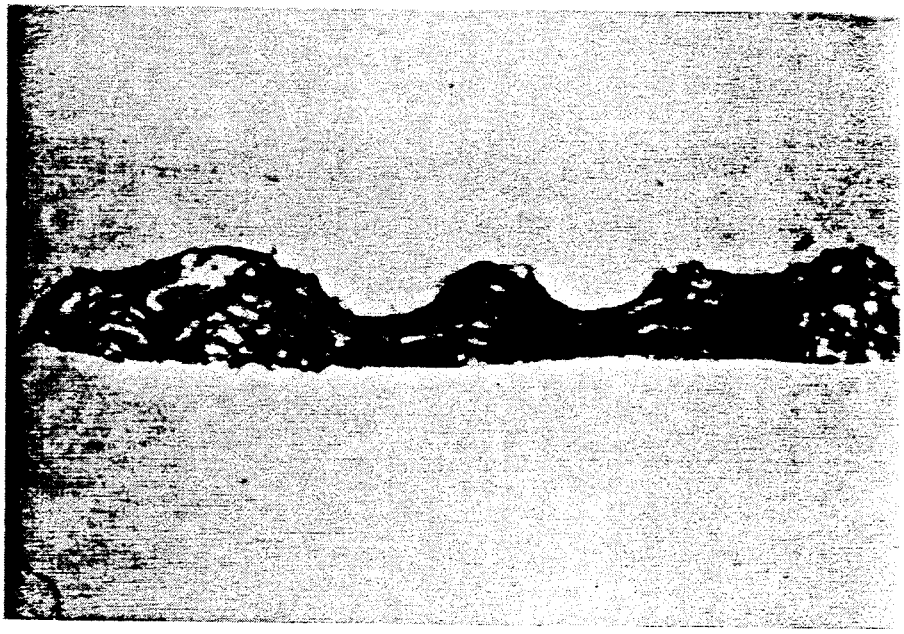
Figure 13A:
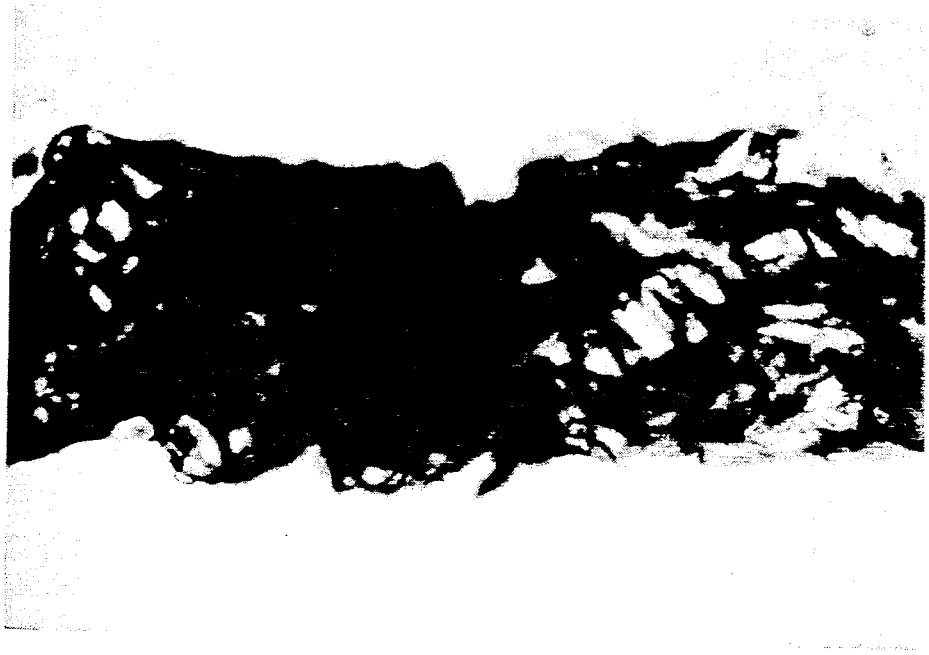
Figure 13B:
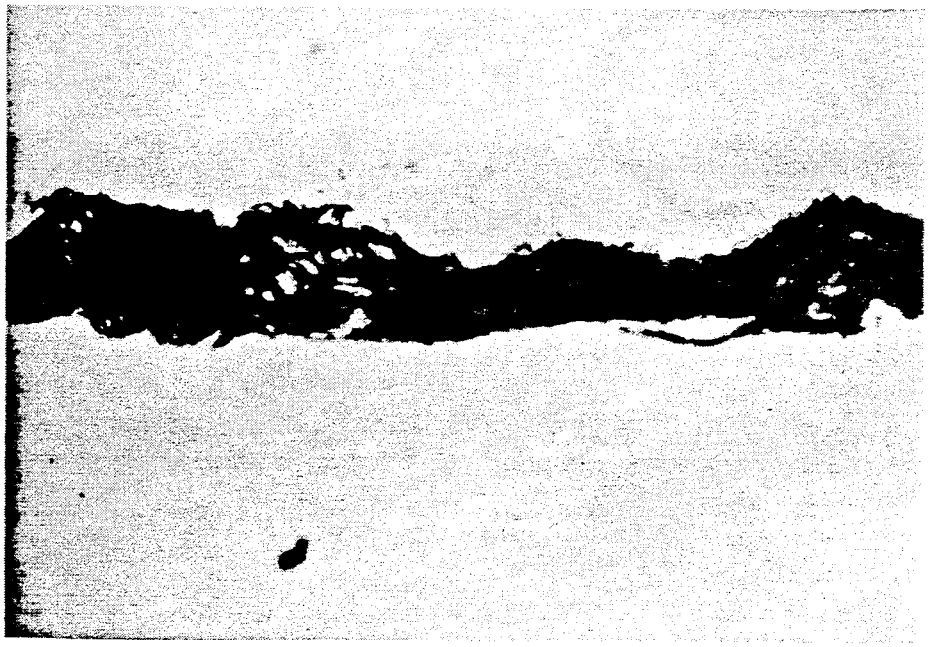
Figure 14A:
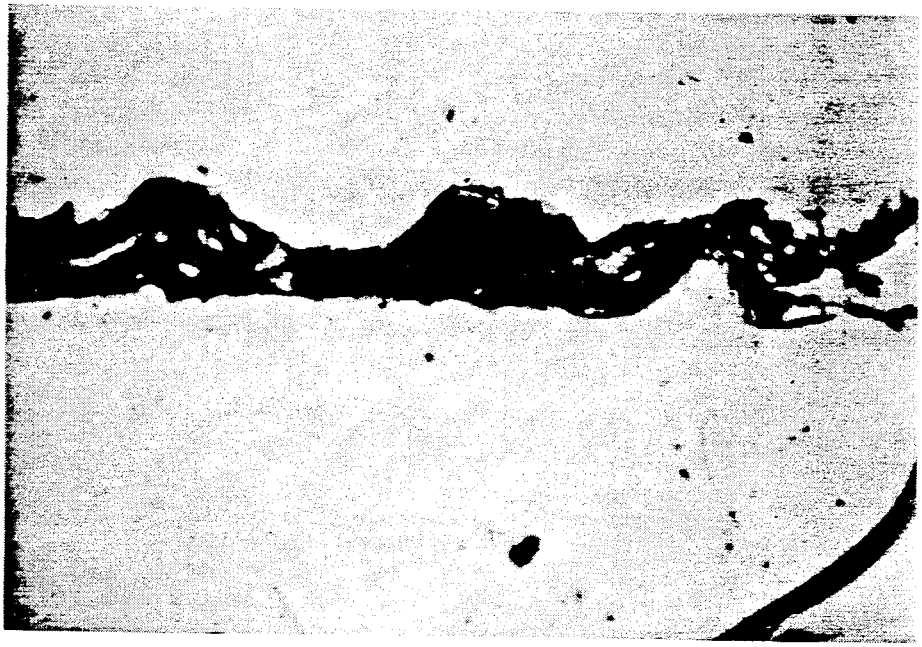
Figure 14B:
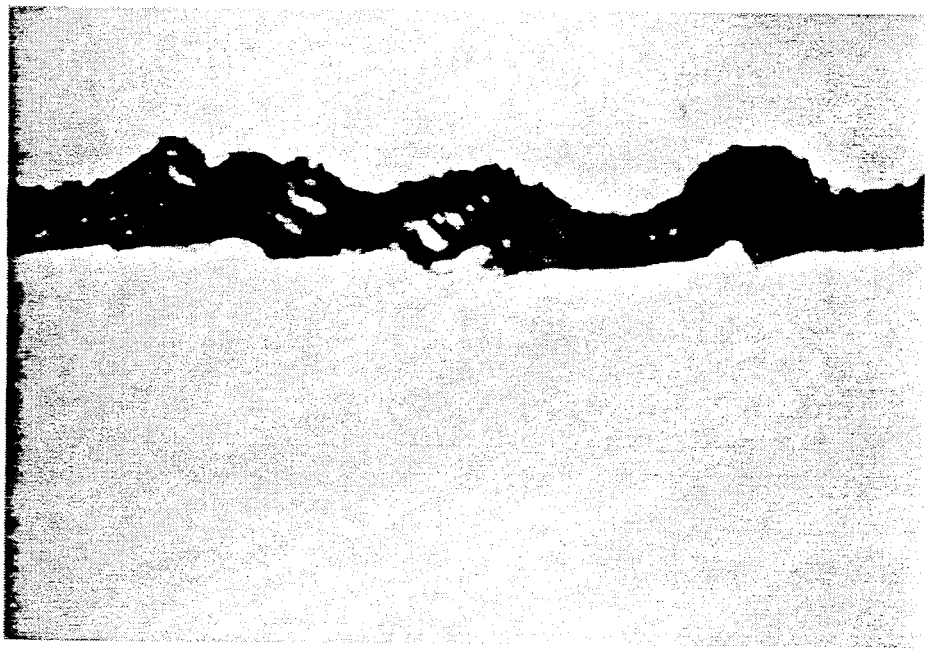
Figure 15A:
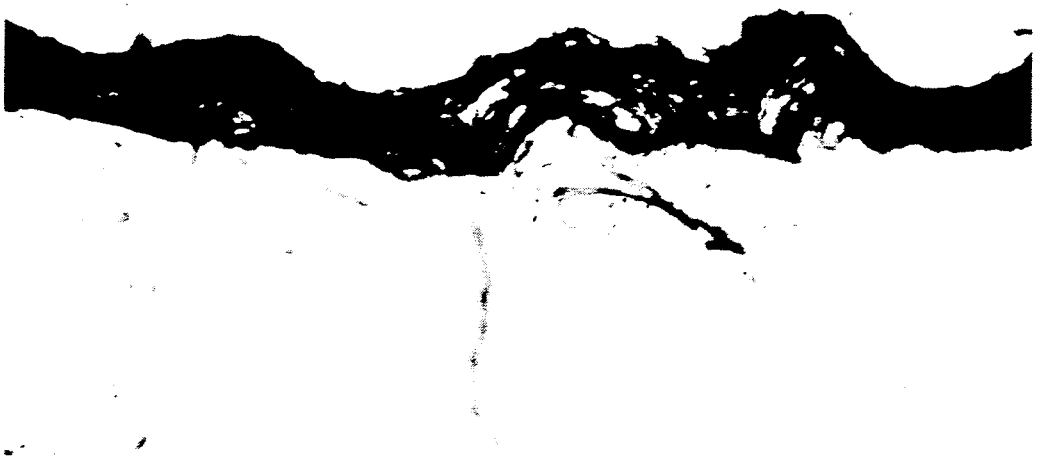
Figure 15B:
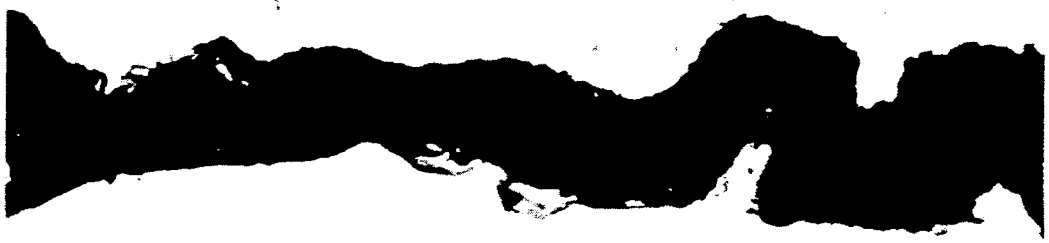
Figure 16A:
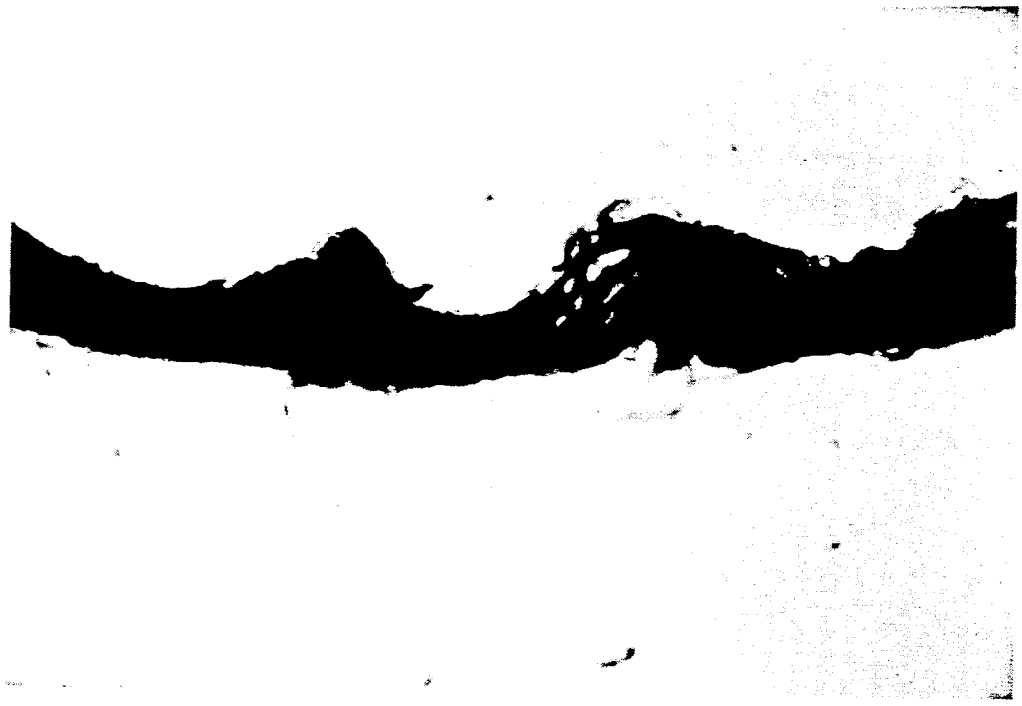
Figure 16B:
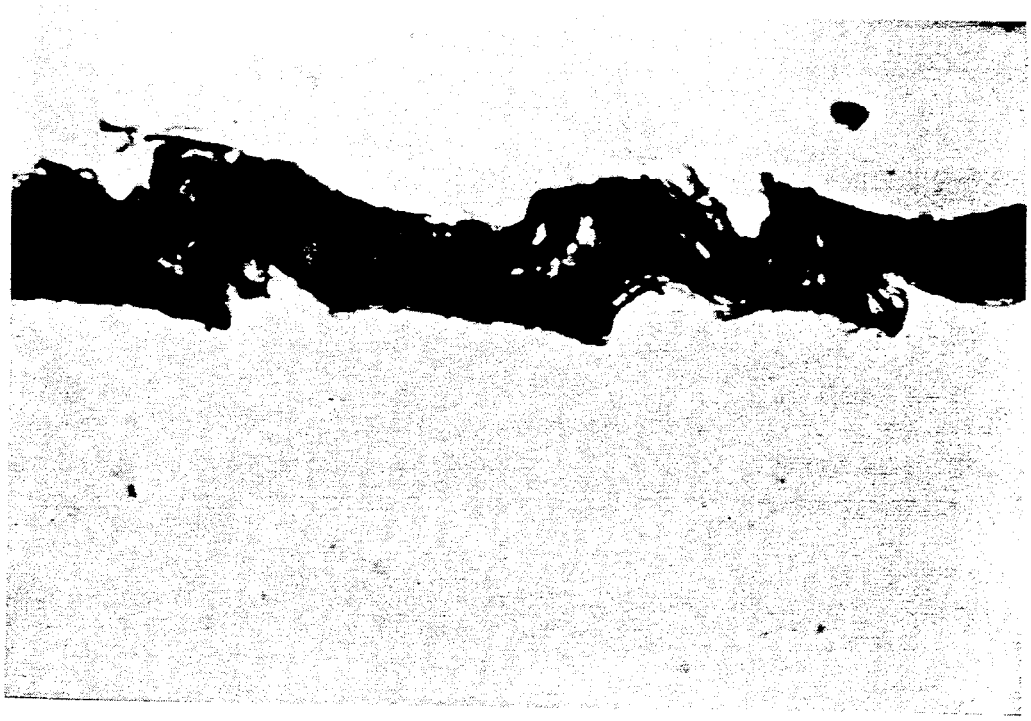
Figure 17A:
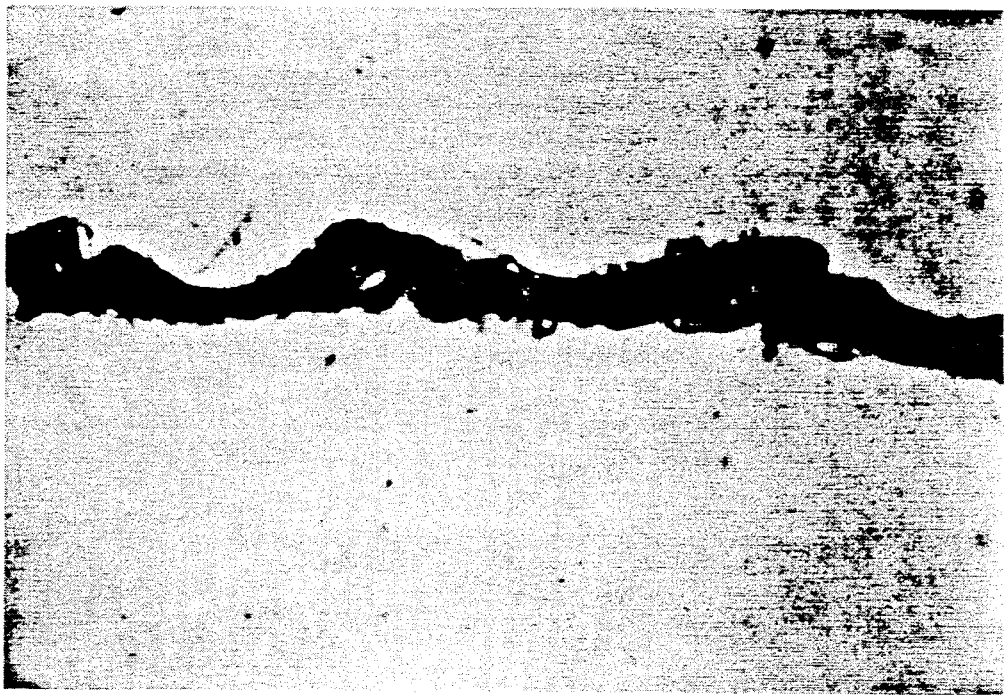
Figure 17B:
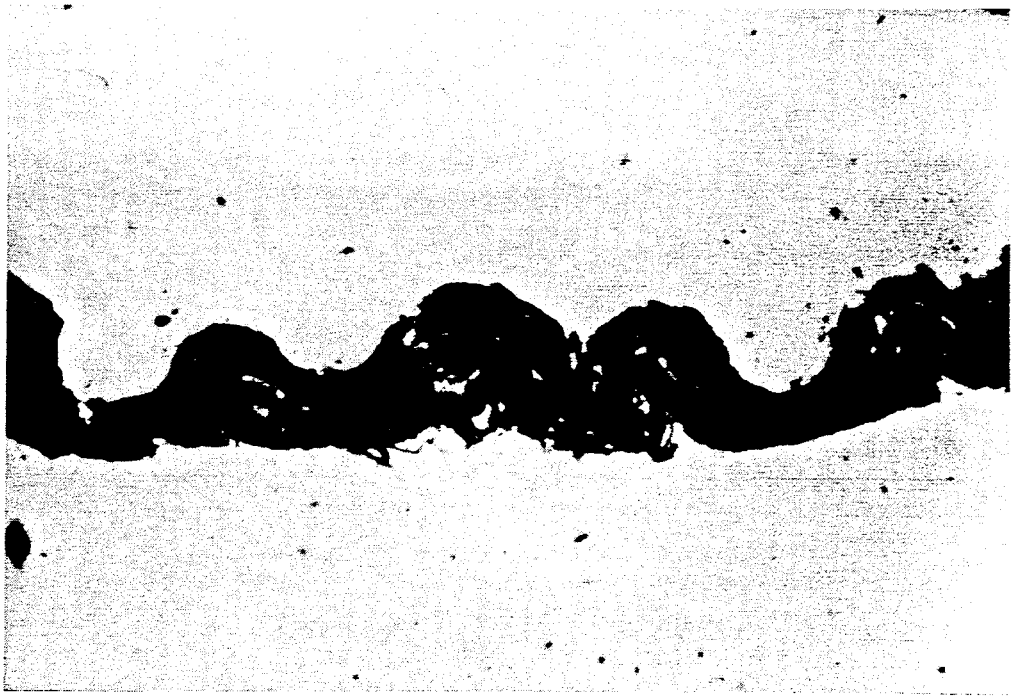
Figure 18:
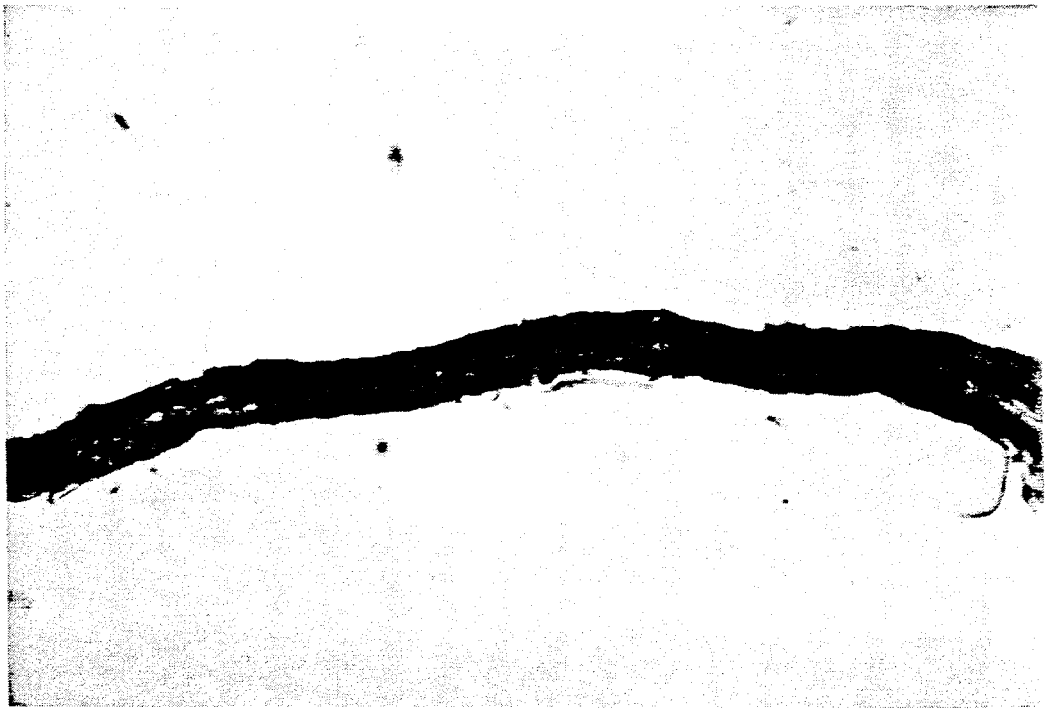
FIG. 18 is a microtome of a Papan product sample.
Figure 19:
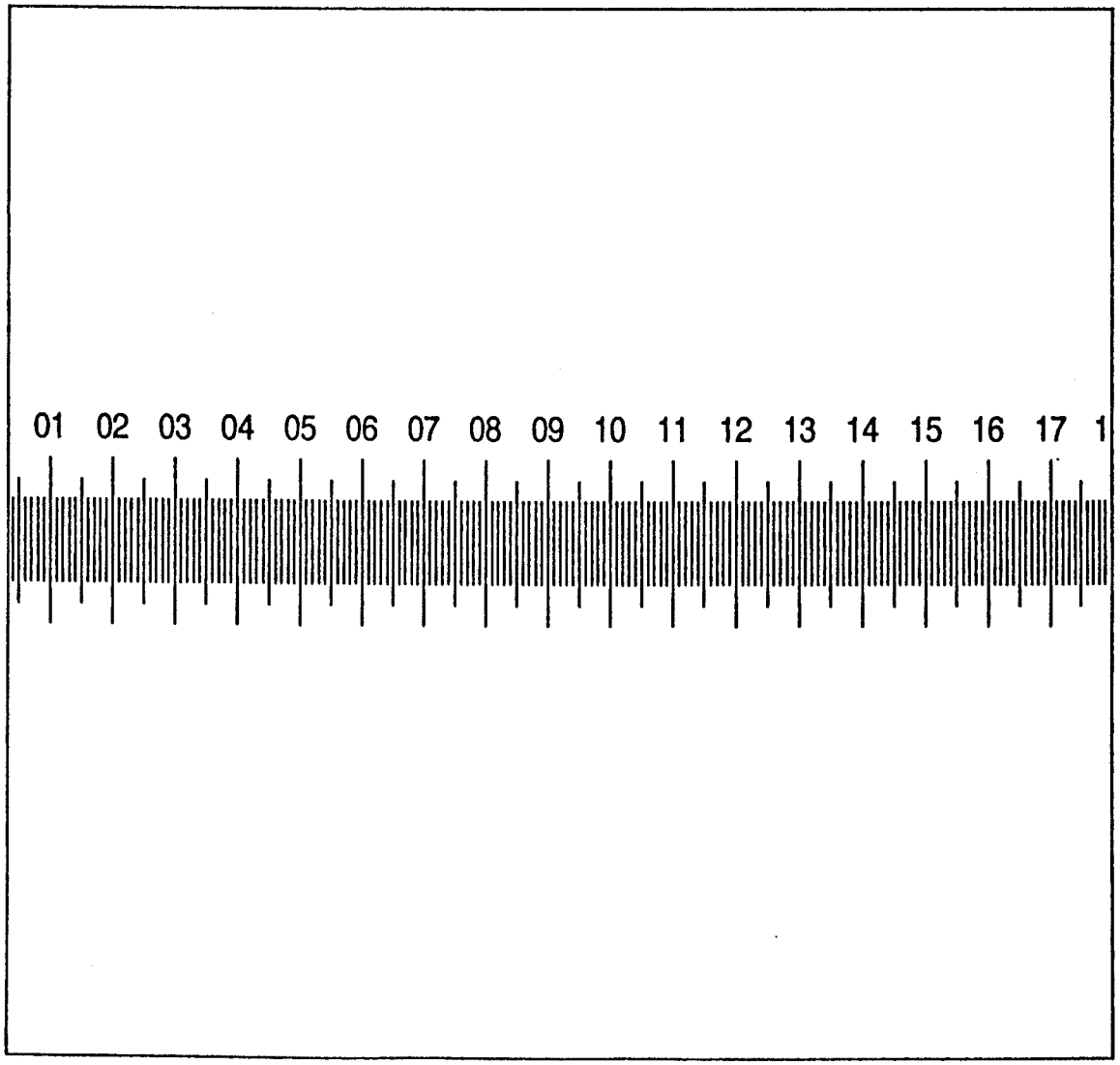
FIG. 19 is a stage micrometer, 0–2 mm, on the same scale as FIGS. 12–18.

In accordance with the invention, the apparatus includes a sheet of fabric material having a first surface with a textured pattern for receiving the web at the web transfer station and for conveying the web from the transfer station at a speed less than the predetermined speed, the sheet of the fabric material being substantially tangential to a point on the outer circumferential surface of the smooth-surfaced roll at the transfer station. As embodied herein, a sheet of fabric material 55 is part of a continuous fabric loop 56 mounted on support rollers 52 and 54 on opposite sides of transfer station 46 and on a plurality of guide rolls 62 and a dryer 60. Stretch rollers 58 may be employed to maintain the desired tension in fabric loop 56. Showers 62 may be employed to clean fabric 55 of fabric loop 56 upon each rotation of the loop and vacuum 66 may be employed for removing excess shower fluid from fabric 55. Fabric 55 is textured in a manner that will impart the desired texture pattern on the fibrous web 24. In one embodiment of the invention, as shown in FIG. 5, a dual layer fabric material comprises a 59×59 weave, 0.025 warp, and 0.027/0.027 shute and is used inside out, that is, the shute runner side contacts the web. A fabric similar to the fabric illustrated in FIG. 5 is available from Albany Wire Co. as Duraform 59-H LDDL. Other fabrics may be used depending upon the desired texture of the paper cover stock product. Such fabrics may be made from metals, elastomerics, ceramics, glass, fiberglass and combinations thereof. Such fabrics may be used to simulate the texture of leather, wood, or other surfaces.

In a preferred embodiment of the apparatus of the invention, the fabric material moves at a speed of about 10% to about 40% less than the surface speed of the smooth-surfaced roll. The fabric material is subjected to a machine direction tension in which the tension in the fabric entering the transfer station is greater than the tension in the fabric leaving the transfer station. Lower basis weights can accommodate larger speed differentials; a larger speed differential, in turn, accommodates the use of a coarser fabric for simulating, e.g., burlap. Preferably, the speed differential, between the fabric and the surface of the smooth-surfaced roll is about 25% where $$\text{Speed Differential} = \frac{\text{Velocity (roll)} - \text{Velocity (fabric)}}{\text{Velocity (roll)}} \times 100\%$$

Because fabric loop 56 moves at a slower speed than surface 44 of smooth-surfaced roll 40, tension in the portion of the fabric loop 56 between the turning roller 54 and transfer station 46, as shown in FIG. 1, will be greater than the tension in the portion of the fabric loop 56 between turning roller 52 and transfer station 46. Depending upon the elasticity of fabric 55 in fabric loop 56, fabric 55 undergoes delongation as it passes through transfer station 46 because of the differential tensions. Specifically, the length of voids 63 in fabric 55, as shown in FIG. 5, are shortened in the machine direction as fabric 55 passes through transfer station 46. Such delongation has a "pinching" effect on web 24 as the web exits from transfer station 46. This pinching helps fabric 55 of fabric loop 56 to firmly hold web 24 as it exits from the transfer station.

Also, because web 24 on smooth-surfaced roll 40 is moving faster than fabric 55, web 24 slows down when it reaches the constricted area between smooth-surfaced roll 40 and fabric 55 in such a manner that the portion of web 24 in this constricted area is pushed from behind by the faster moving portion of web 24, causing some of the slower moving portion of web 24 to be forced into open voids of fabric 55, which in turn causes fabric 55 to hold web 24 and creates an undulated or embossed surface on web 24 when web 24 is subsequently separated from fabric 55.

Figure 3:
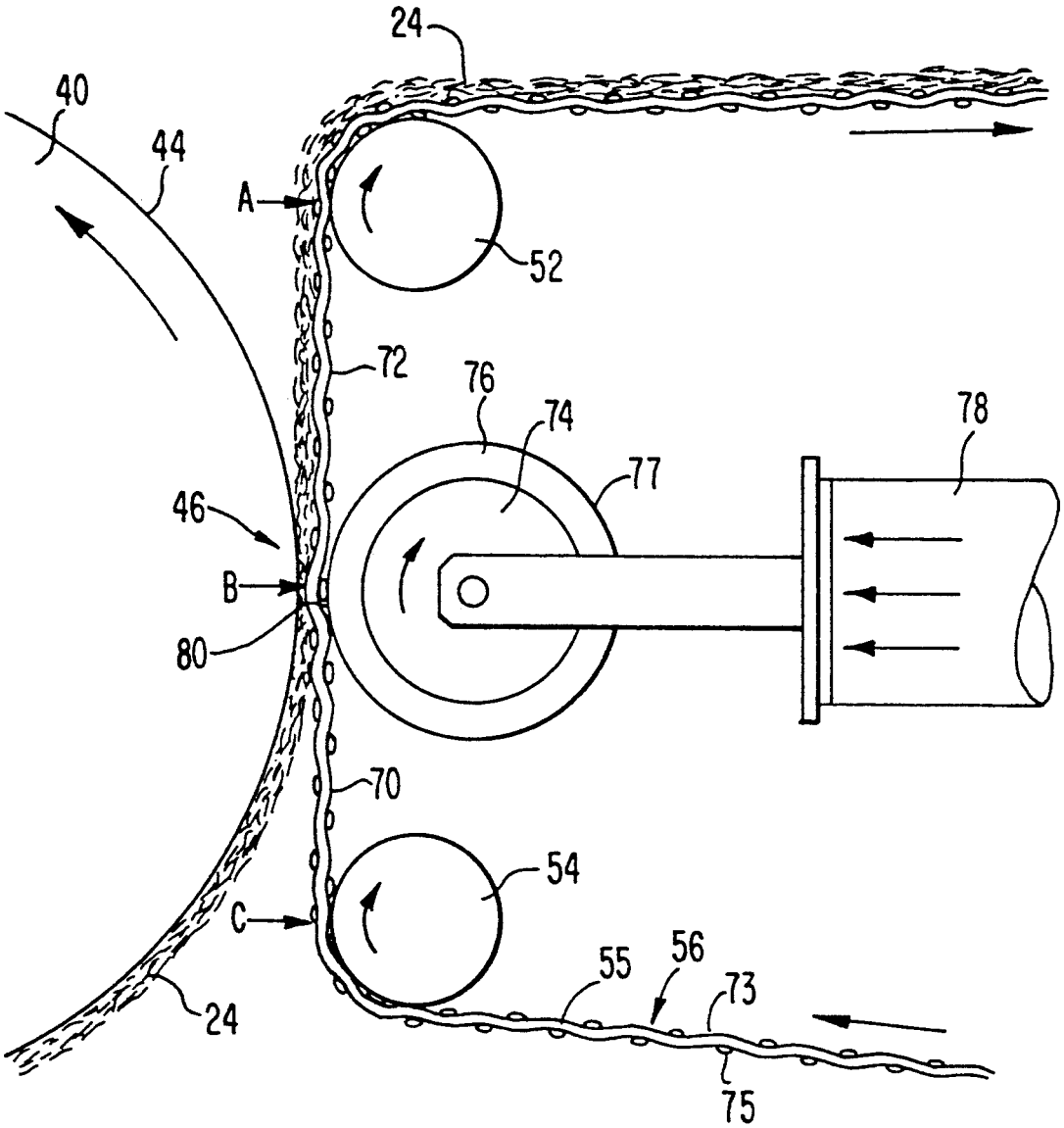
FIG. 3 is an enlarged view of the transfer station portion of the apparatus shown in FIG. 1.

In accordance with the invention, the apparatus includes compression means acting with a compression force between about 5 lbs/linear inch and about 100 lbs/linear inch or more on the web through the sheet of fabric material for transferring the web from the smooth-surfaced roll to the sheet of fabric material, and for compressing the web against the textured surface pattern of the fabric material. In tests, no upper limit to the compression force has been achieved. An enlarged view of the transfer station portion of the apparatus of FIG. 1 is shown in FIG. 3. Preferably, the compression means comprises a back-up roller 74 covered with a material 76 having a hardness between 80 and 90 (Durometer Shore A). Back-up roller 74 abuts a second surface 73 of the sheet of fabric material 55 opposite first textured surface 75 and a compression nip is defined by surface 44 of smooth-surfaced roll 40 and first surface 75 of fabric material 55.

The compression means preferably includes back-up roller adjusting means for moving the back-up roller toward and away from the smooth-surfaced roll to adjust the compression of the fabric material against the web and smooth-surfaced roll. Preferably, the first surface of the fabric material is tangential to the surface of the smooth-surfaced roll at the second compression nip when the back-up roller is adjusted away from the smooth-surfaced roll.

As embodied herein, the adjusting means comprises a power cylinder 78 for moving back-up roll 74 toward or away from smooth-surfaced roll 40. Turning rollers 52 and 54 support fabric 55 on opposite sides of back-up roll 74 so that the surfaces of turning rolls 52 and 54 and the surface 44 of smooth-surfaced roll 40 are aligned in a straight line at points A, B, and C, as shown in FIG. 3, to support fabric 55 at a tangent to outer surface 44 of smooth-surfaced roll 40 at second compression nip 80. Because points A, B, and C are aligned, the tension of fabric 55 does not add to the compression force applied by smooth-surfaced roll 40. Similarly, because of the alignment of points A, B, and C, back-up roll 74 does not have to overcome any tension or forces in fabric 55 acting against back-up roll 74. Accordingly, back-up roll 74 can be controlled to apply the desired compression force of between about 5 lbs/linear inch and about 100 lbs/linear inch against the smooth-surfaced roll without having to overcome opposing forces in fabric 55. According to another preferred embodiment, either or both turning rollers 52,54 (or 152,154) are displaced to the right in FIGS. 1, 3 (or 2, 4) so that fabric 55 slightly wraps, for example, back-up roller 74.

Preferably, the fabric is pressed against the web with a compression force of about 60 lbs/linear inch with an average pressure of about 150 psi in the compression nip. Because the compression force can be so exactly controlled, a compression force can be applied to a web that is sufficient to cause the web to transfer from smooth-surfaced roll 40 to fabric 55. The exact control further allows control over the amount of emboss imparted on web 24 so that the textured pattern and web 24 can be closely controlled in order to achieve the desired surface texture.

In accordance with the invention, the apparatus further include means for drying the web after compression, the dried web having an apparent density in the range of about 4 to about 6.67 lb ream of 3000 square feet/caliper pt in mils. As shown in FIG. 1, drying means may comprise conventional dryers 60 as are well known. In FIG. 1, fabric loop 56 is shown transporting web 24 to the first of the dryers 60, after which web 24 is threaded through the next dryer.

Figure 4:
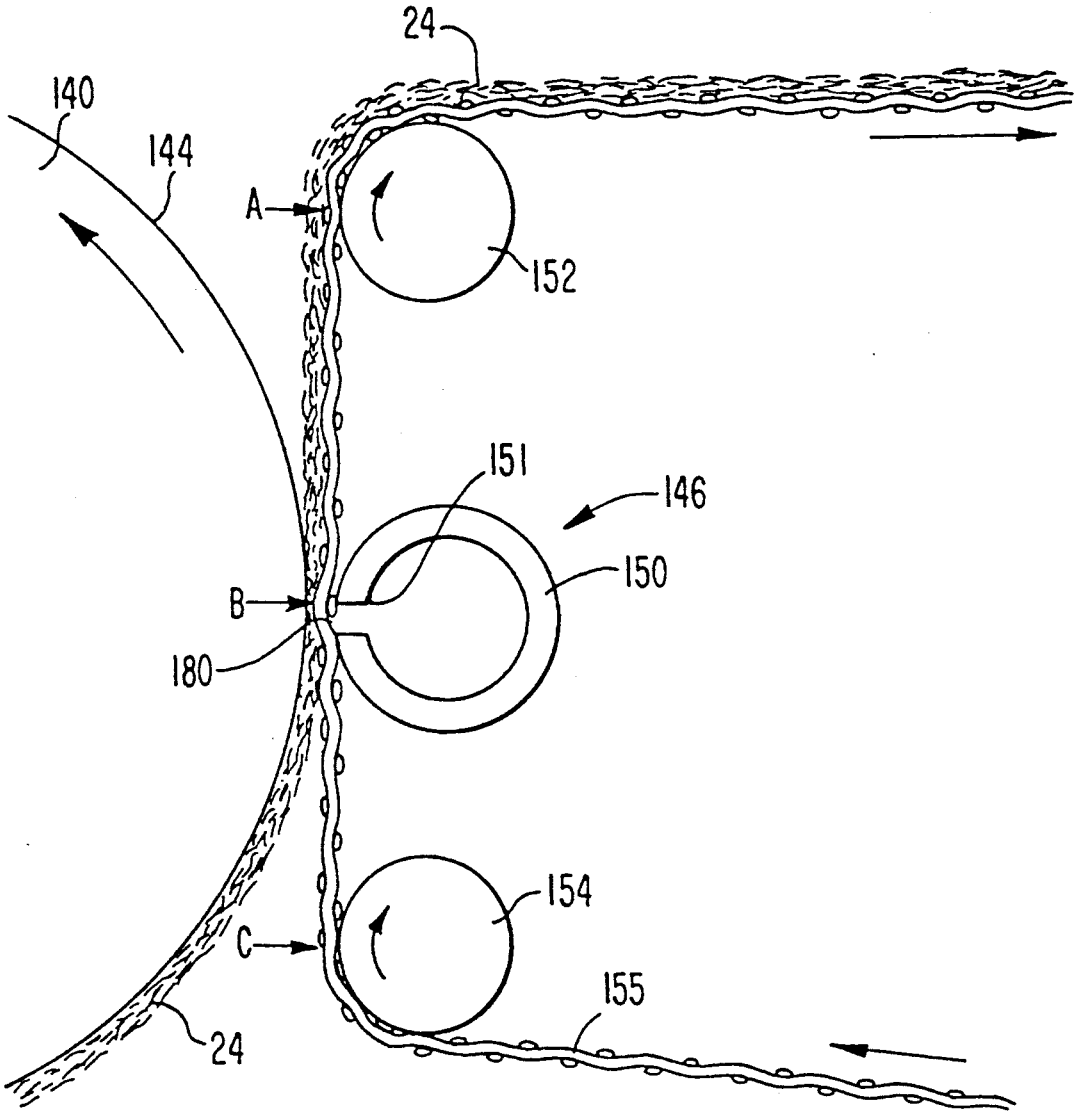
FIG. 4 is an enlarged schematic side elevational view of an embossing portion according to another embodiment of the apparatus that may replace the transfer station shown in FIG. 3.

According to another embodiment of the invention, as shown in FIG. 4, the apparatus for manufacturing a paper cover stock having a textured surface pattern may include vacuum means disposed at transfer station 146 for directing a vacuum through the material to the web. As embodied herein, and shown in FIG. 4, vacuum means includes vacuum roll 150 having a vacuum slit 151 that applies a vacuum through fabric 155 to a web 24 in nip 180. An outer surface 144 of smooth-surfaced roll 140 conveys dewatered web 24 at a predetermined speed to nip 180 in transfer station 146. Fabric 155 should be fluid pervious to allow passage of vacuum pressure from vacuum roll 150. A vacuum of between 1 and 18 inches of mercury may be applied through slit 151.

The Method

The method of the invention comprises a series of steps including the step of forming a wet fibrous web. Preferably, a dilute slurry of fiber and water is deposited on a flat, moving, foraminous surface, such as a felt or a Fourdrinier wire, to form a wet web of fibers which is substantially transferred to another moving felt. The fibers are preferably wood lignocellulosic but may also be other natural fibers or synthetic wood fibers.

In accordance with the method of the invention, the wet fibrous web is partially dewatered to between about 30% and about 60% solids. In the preferred embodiment, a lignocellulosic web is pressed in a nip defined by rotating rolls. Water removed from the web is retained by the felt on which the web is conveyed.

Other known methods may be used for forming a wet fibrous web and for partially dewatering the web to the required percentage of solids. Conventional wet compressing techniques are well known in the paper making industry. Partially dewatering the web enables the compression step to provide the desired final web characteristics and makes for more energy efficient drying of the prepared web material. However, it is important to note that the web remains 70% to 40% wet after dewatering. Over-drying of the web can substantially reduce the effectiveness of subsequent manufacturing steps for producing paper cover stock having a textured surface pattern.

In accordance with the invention, the method includes the step of conveying the partially dewatered web on a smooth-surfaced roll to a compression nip defined by the smooth-surfaced roll and a fabric material having a textured surface pattern. The fabric material is moved at a speed of about 10% to about 40% less than the surface speed of the smooth-surfaced roll. In the presently preferred embodiment, the speed differential is about 25% where $$\text{Speed Differential} = \frac{\text{Velocity (roll)} - \text{Velocity (fabric)}}{\text{Velocity (roll)}} \times 100\%.$$

This speed differential causes undulations to develop on the textured surface of the web being imprinted by the fabric, undulations that have unsually good detail and surface aesthetic qualities. The speed differential gives additional web material for the formation of detailed surface undulations that convincingly simulate a look of conventional cover materials such as fabric or leather.

In accordance with the invention, the web is heated in the vicinity of transfer station 46. In tests, web 24 has been heated by heating smooth-surfaced roll 40. With this method, smooth-surfaced roll 40 should be heated to about 150°-210° F. Also, with this method, the higher the linear speed of the web, the less uniform the temperature through the web thickness. Other methods of heating the web could include infrared, microwave, or steam heat which may or may not include heating the surface of roll 40.

In accordance with the invention, the method includes the step of compressing the web in the nip by forcing the fabric material against the web on the smooth-surfaced roll to directly transfer the web from the smooth-surfaced roll to the material, the fabric material being compressed against the web with a compression force of from about 5 lbs/linear inch to about 100 lbs/linear inch or more (no upper limit is known), the average pressure in the compression nip being between about 20 psi and about 400 psi, the fabric imprinting a textured pattern on a surface of the web, the web being further compressed and textured by the difference in speed between the fabric material and the surface of the roll.

As shown in FIG. 3, web 24 is compressed by surface 77 of back-up roller 74 and powered cylinder 78 adjusts the compression force of back-up roller 74 against surface 44 of smooth-surfaced roll 40. Fabric 55 has a first surface 75 facing smooth-surfaced roll 40 that is textured with a pattern that is negative of the textured pattern to be imprinted on web 24.

The textured pattern on web 24 is produced by two determinants. First, back-up roller 74 presses fabric 55 against web 24 to emboss web 24 with a desired textured surface pattern; second, the slower speed of fabric 55 as compared to the speed of surface 44 of smooth-surfaced roll 40 adds further texture to web 24. These first and second determinants together comprise a differential wet emboss that produces a surface with improved surface texture detail and a greater caliper than can be obtained with other known texturizing methods.

According to a preferred embodiment of the invention, the fabric material is subjected to a tension on opposite sides of the compression nip, the tension being greater in the fabric material entering the compression nip at the web transfer station than in the fabric material leaving the compression nip at the web transfer station. As embodied herein, the greater speed of surface 44 of smooth-surfaced roll 40 as compared to the speed of fabric 55 causes tension in fabric 55 entering nip 80 to be greater than tension in fabric 55 leaving nip 80. Depending on the elasticity of the fabric, the length of the voids 63 in fabric 55 are shortened in the machine direction as fabric 55 passes through nip 80. This shortening has a "pinching" effect on the web which may contribute to the texturizing of the web surface. The pinching effect also helps fabric 55 to hold onto web 24 after exiting nip 80.

In accordance with the invention, the method further includes the step of drying the web after compression, the dried web having an apparent density in the range of about 4 to about 7 lb ream of 3000 square feet/caliper pt. in mills. As shown in FIG. 1, the web is dried on cylinder dryers to which it is transferred and dried in a known manner.

According to another preferred embodiment of the invention, the method may include the step of applying a vacuum through the fabric material at the compression nip to directly transfer the web from the smooth-surfaced roll to the fabric material and to generally conform the surface of the web in contact with the fabric material to the textured surface pattern of the material while the surface of the web opposite the fabric material remains substantially smooth.

The Product

The method of the invention produces a paper cover stock material having unique physical characteristics that are advantageous for use in cover material such as bookcovers. Specifically, the product comprises a sheet of fibrous paper cover stock material having a textured surface pattern, the sheet of fibrous material having first and second surfaces, and an apparent density in the range of about 4 to about 7 lbs ream of 3000 square feet/caliper pt in mils, wherein the first surface has a textured surface pattern and the second surface is substantially smooth.

It is preferred that the sheet have a basis weight between about 25 and about 75 lbs/3000 square feet. It is also preferred that, at basis weights greater than about 50 lbs, the sheet have a caliper greater than 0.008 inch. The product of the present invention has the advantage that it has a higher caliper for a given basis weight than other paper cover stock materials. Because a higher caliper is obtained at a lower basis weight, less fiber furnish is required to produce a given quantity of product of a desired caliper than is the case with conventional cover stock products. Accordingly, product costs are reduced.

In tests, a caliper range of about 0.009 to about 0.013 was achieved, although it is expected that a caliper as low as 0.008 inch could be produced depending on such factors as fabric, basis weight, and backroll pressure. In some applications, a caliper under 0.010 inch may be commercially advantageous.

It is further preferred that the sheet stretch or elongation in the machine direction be more than two times greater than the sheet stretch in the cross direction. Preferably, sheet stretch in the machine direction is at least about 5% and sheet stretch in the cross direction is at least about 3%. This is beneficial to the book covering art because it provides more processing latitude in the bookbinding process.

In the preferred embodiment of the invention, the sheet comprises a web of wood fibers. In other embodiments of the invention, web fibers may comprise cotton, sisal, flax, or other carbohydrate fibers or synthetic wood fibers. The sheet fibers may also comprise a mixture of the above fiber types stratified in various fiber layers. Thermoplastic felt fibers can also be used. The fiber sheets may be impregnated with latex or other additives to change the physical characteristics of the sheet.

In tests, the product, directly from the paper machine without any coating or other treatment, was evaluated on a commercial Kolbus bookbinding line. Cases were supplied to the bookbinding equipment using a bottom-feed case unit. A stack of cases about 16" high was placed in the unit. The cases were fed one at a time from the bottom of the stack at the rate of from 80 to 100 cases per minute. This method is commonly used to feed book processing units for the "building-in" process and for foil stamping book covers.

When the product was used in this equipment, a problem termed "scuffing" arose. Scuffing is a localized delamination of the substrate, causing a torn area in the cover stock. It was especially apparent in three-piece case construction. The case is constructed from two side panels and one spine cover over the usual binder's board. The spine piece typically overlaps a narrow portion of the two side panels. When this construction was run on a bottom-fed Kolbus unit at high production speeds, the scuffing produced an undesirable delamination in the cover stock.

To prevent this scuffing problem, a protective coating was applied to the surface of the product. Its purpose is to reduce surface friction and improve the strength of the surface. In commercial operation, this coating would be applied in line on the paper machine without densifying the product or causing an undesirable loss of grain depth.

It has been possible to successfully apply a starch protective coating using reverse roll coating techniques. The coating consists of an ethoxylated starch, modified with surface tension reducing surfactants and with interfacial tension reducing surfactants such as du Pont's Zonyl FSO and Rohn & Haas' Triton X-405, respectively. The coating was dried with conventional gas-fired, forced hot-air ovens. Coating weights were 0.7 to 1.2 lbs/1,000 $ft^2$ dry on dry basis. There was no significant loss of grain depth in this coating operation.

When product that was modified with this coating was run on commercial Kolbus bookbinding equipment, all of the samples produced showed no scuffing problem, while uncoated control samples showed typical levels of failure.

The scope of protective coatings is not limited to ethoxylated starch application. The uses of other types of starches, latex blended starches, animal glues, and blends of latices are possible modifications. Also, other methods of application such as spray, size presses, curtain coaters, air knife coaters, Mayer Rod coaters, and other conventional methods are possible.

The product produced by the method and apparatus is especially suited as a paper cover stock for book covers. The produced product has a first textured surface that simulates the look of conventional cover stock materials and an opposite second surface that is substantially smooth for application to, e.g., cardboard book covers. The cover stock material will not change its textured pattern even after aqueous glues are applied to the substantially smooth surface to adhere the cover stock to the cardboard book covers. The cover stock of the present invention also has a resiliency especially useful in book cover covering materials. Preferably, a sheet of the present invention has an "MIT" double fold rating of at least 1,000 in the machine direction. This means that a sheet has to be folded back and forth at least 1,000 times along a crease perpendicular to the machine direction of the sheet before the sheet ruptures along the crease. As can be seen in Table 4, this double fold rating compares favorably with conventional textured sheets. A further advantage of the present invention is that the sheet is resistant to tearing in both the machine and cross directions. Preferably, at least 200 grams is required to continue a tear in the sheet in either the machine direction or the cross direction as applied in the standard Elmendorf Tear Test. This resistance to tearing is significantly greater than the resistance in conventional textured sheets, as seen in Table 4. This characteristic is especially important for book covers because the value of a covered book is substantially reduced if the cover tears. In covering a book, it is important that the cover stock material have a high machine-direction tensile strength. Preferably, the cover stock material can absorb at least 5 lbs of tensile energy in the machine direction before rupture. It is also preferred that the cover stock material have a machine-direction stiffness less than 4 taber stiffness units.

Visual aesthetics, particularly the ability to simulate the appearance of a textile, for example, are key to the commercial value of the product of this invention. Measurements were taken to characterize the surface topography that generates the unique surface appearance. These topography measurements included measurements of ridge count, grain depth, and grain depth retention.

Ridge count refers to the number of ridges that occur in the machine direction and is a significant factor in definition of product aesthetics. It is a measure of the textured structure as sensed by the hand. Higher ridge counts are normally preferred. This measurement, along with the depth measurement, comprises an approximate method of characterization of the surface topography.

Ridge count is obtained by counting the number of ridges per inch under a binocular microscope. Typically, the maximum possible ridge count is the ridge count of the fabric. Subsequent processing and winding will reduce the ridge count through elongation and compression.

Figure 31A:
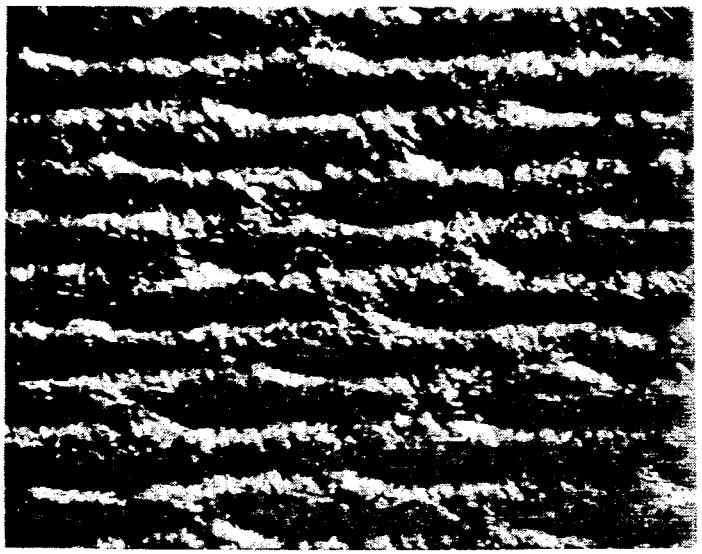
FIG. 31A, B show the machine direction ridge count in the product of the invention.
Figure 31B:
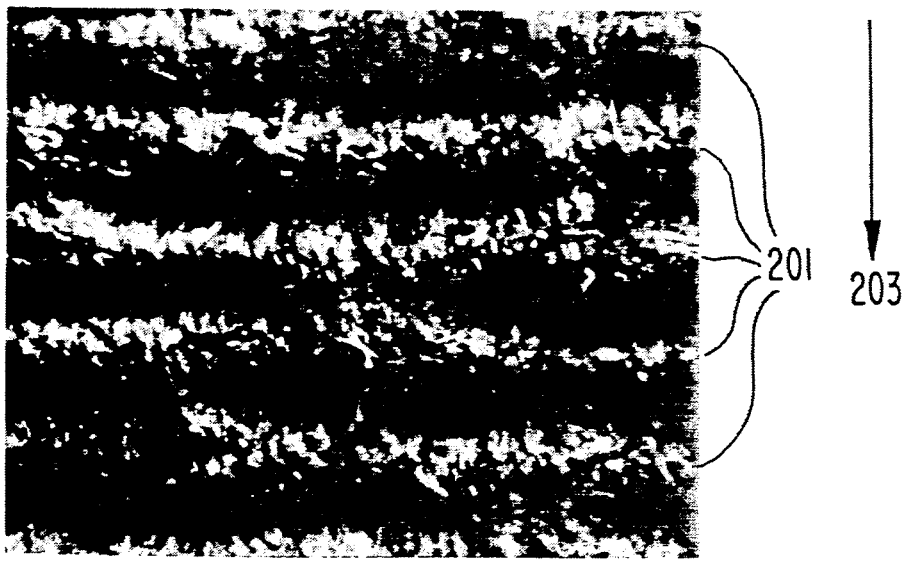

The LDDL fabric usually has a ridge count of 49 filaments/inch, see FIG. 5. Normal drying processes will lower the count in the finished product to the 30–40 range. Measuring ridges 201 in machine direction 203, as shown in FIG. 31, the ridge count for one sample of the product of the invention is about 40 ridges per inch.

Depending on fabric design, it may also be desirable to measure ridge counts in both machine and cross machine directions. This would be advantageous to characterize the topography that is important to control the tactile aesthetics.

Topography measurements also included measurement of grain depth retention under moisture and pressure exposure because book covers are subjected to this exposure in the normal process of bookbinding.

Typically, a hot animal glue solution in water is applied to the back of the cover stock. The cover stock is then forced around binder's board to form the case of the book. The cases are then stacked for temporary storage, and often are placed in high stacks on pallets. These conditions subject the cover stock to forces that tend to cause loss of grain depth; the combined effects of moisture and pressure tend to urge the surface of the cover stock back to its original wet-formed condition.

With off machine or post-embossed cover stocks, the wet-formed condition was essentially flat as it was forced on the paper machine wire.

With the product of the invention, on the other hand, the wet-formed condition is the high grain depth surface. The product has a much greater tendency to retain its grain depth. Thus, the product not only has greater grain depth and therefore better aesthetics, it will also hold its grain depth better under conditions of water and pressure exposure. This is a highly desirable attribute for materials to be used in the book cover and related decorative cover business. It permits wide processing latitude, while retaining the desirable textile-like appearance.

Among the various means of quanitifying these capabilities of the product are mechanical surface profilometry (stylus) and depth measurement microscopy.

Using a Bendix mechanical profilometer, Model 18 Type VE, a stylus traces over the surface (much like a phonograph needle). This generates an electrical signal that is amplified and transmitted to a recorder or computer. Multiple traces that are laterally offset from one another can be used to map the surface. This same technique can be used to generate means, standard deviation, etc. from information in a computer. FIGS. 21 to 27 show an example of the output on scalloped samples and nonscalloped samples.

Depth-measuring microscopy was selected to take accurate readings, and enough readings to be statistically significant. Additionally, the same microscope equipped with an eyepiece reticle can be used to take lateral measurements of the product surface.

Figure 28:
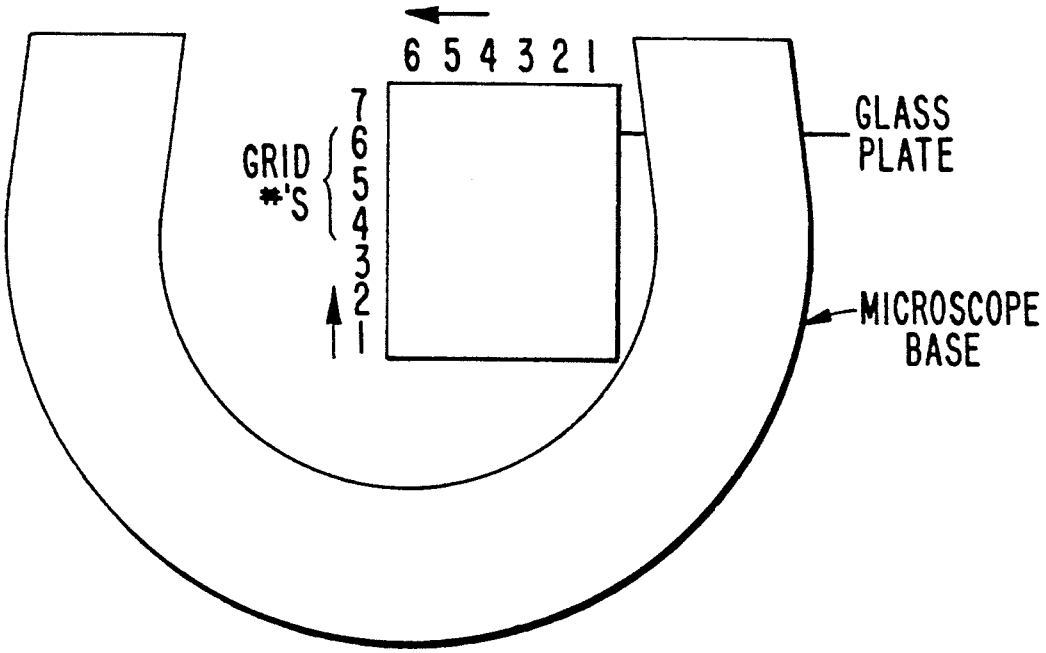
FIG. 28 is a schematic representation of the depth-measuring microscopy layout.
Figure 29:
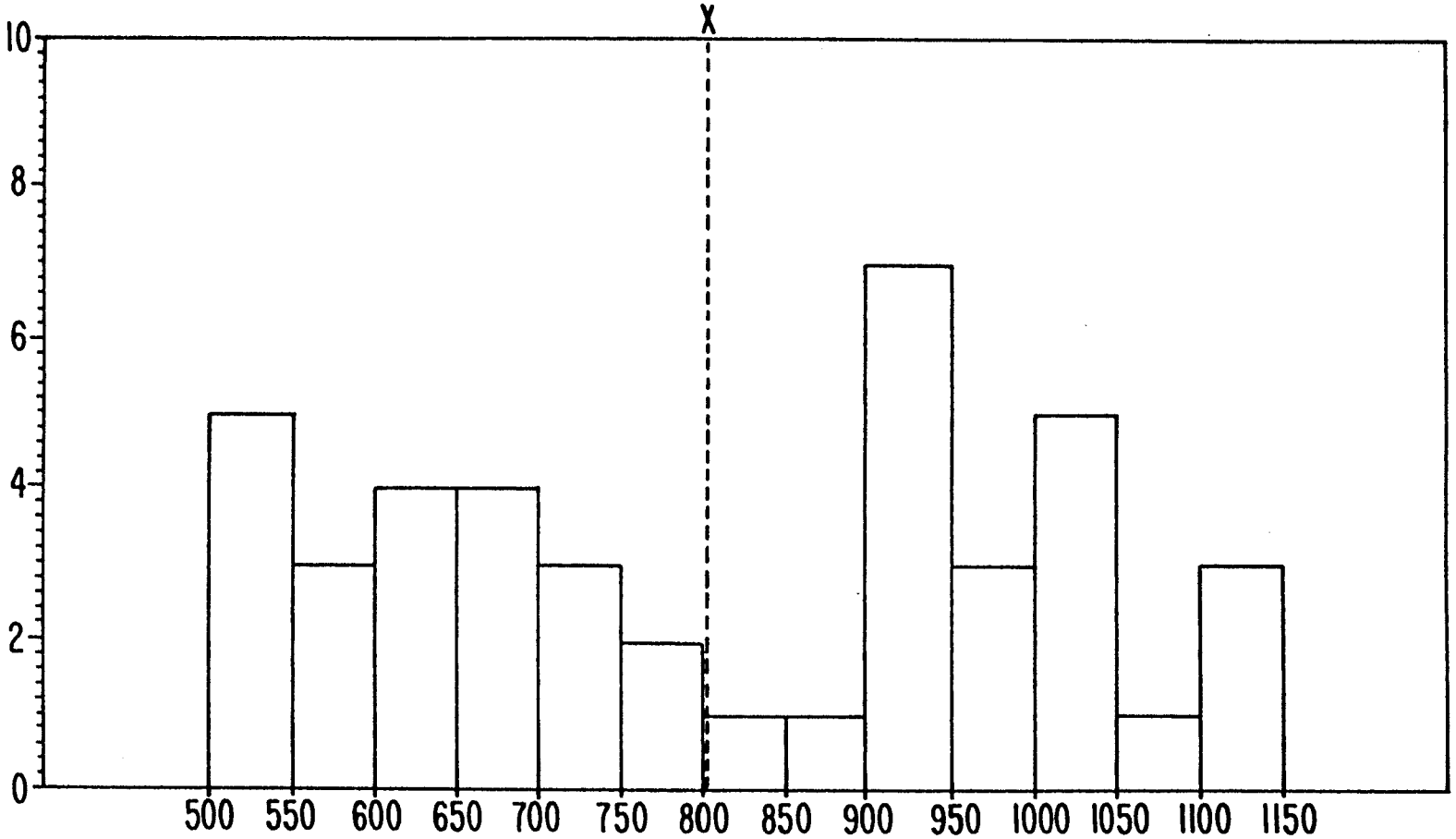
FIGS. 29–30 are histograms of cross machine direction top valley measurements of the topography of the product of the invention.
Figure 30:
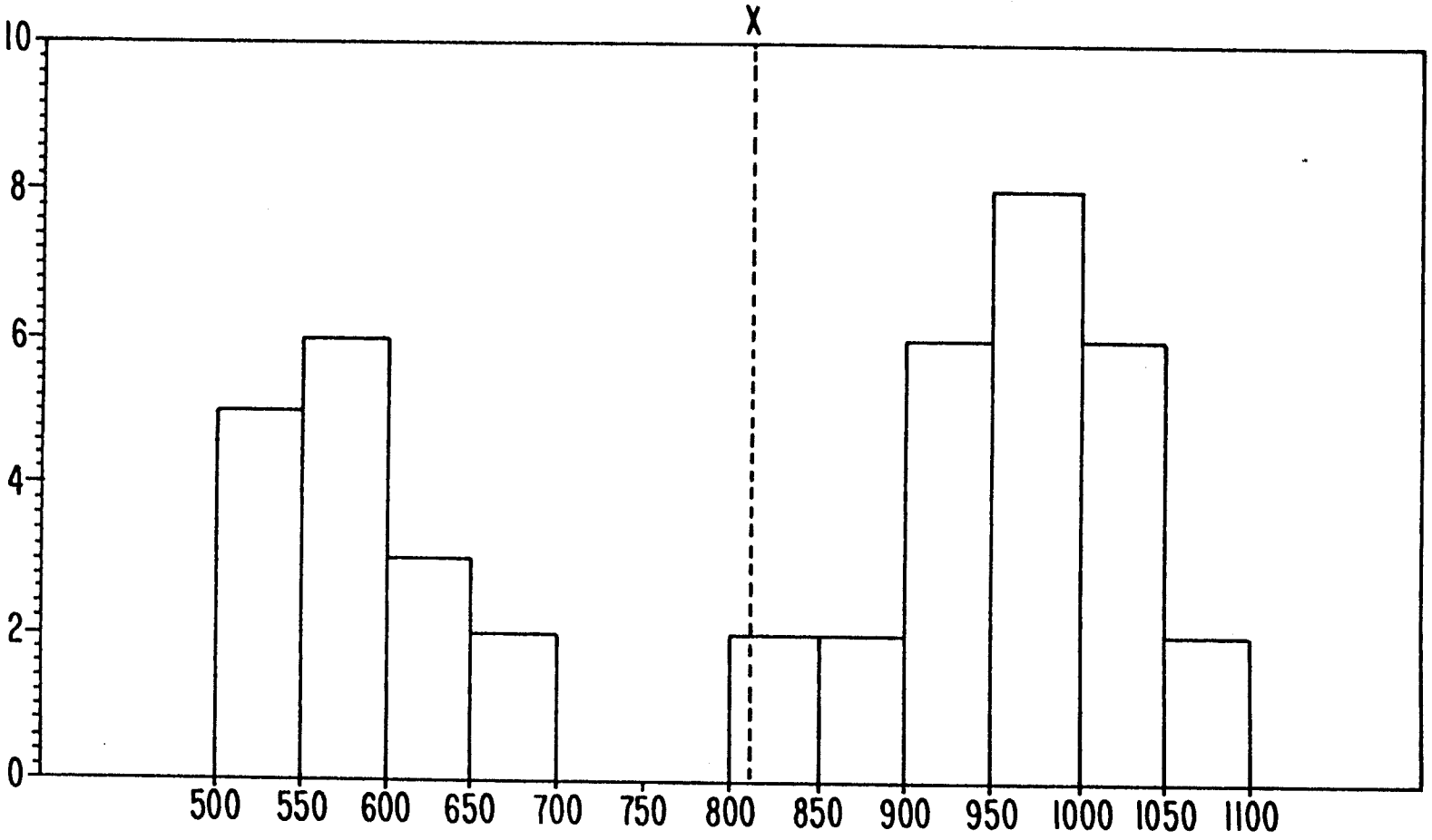

The Reichert-Jung AO Optical Depth Gauge, model number K2301, depth-measuring microscope was used extensively to measure both depths and peak-to-peak lengths on both the tops and bottoms of the surface. In order to do this, two types of samples were prepared for measuring. The first type of sample consisted of 2"×2" pieces of product from six different trials run at either Camas, Wash., or Neenah Technical Center, Wis., and a dry embossed sample known as Papan Buckram. These samples were taped onto a piece of Mylar using two-way tape. They were then taped onto a 2"×2" glass plate. A grid was drawn on a piece of graph paper and taped down to a smooth surface. The microscope was placed in such a way that the plate could be moved horizontally six grid boxes or six times. It could be moved vertically (up) a total of seven grid boxes for a total of 42 measurements per sample. See FIG. 28.

The other type of sample consisted of moistened product and Papan Buckram in order to study grain-depth retention. These also were 2"×2" squares which were placed in water for 15 minutes and then placed between two glass plates with a 3 kg weight placed on top. These samples were allowed to dry for one hour in a 160° F. oven in this manner. After one hour, the samples were removed and allowed to finish drying for an additional ten minutes. The grain depth was evaluated using the same procedure.

Depth measurements were taken on each sample. This was achieved by focusing on the bottom plane of the sample and following the line of focus until the top of the sample was just out of focus. The reading was taken off the indicating depth dial on the microscope.

Peak-to-peak length measurements were taken only on NTC 2806-6, CAMAS 91, and CAMAS 34. This was achieved by using the reticle in the 15× eyepiece of the microscope. All measurements were taken using this eyepiece along with the 20× objective. Each division was equal to 2.5 microns so each measurement was multiplied by this number. The microscope was focused on the bottom plane of the surface. What was visable were two lines forming a channel, having the following characteristics:

1. anfractuous perimeters
2. roughly equidistant sides
3. meandering center-line direction
4. ending in generally hemispherical junctions The width of the channel was measured. The field of focus was then brought up as in the depth measurements. Two areas on either side of the channel would come into focus as the channel went out of focus. The distance between these two focused areas was then measured. In this manner, two measurements were recorded for each grid area and designated as bottom valley and top valley measurements.

RESULTS OF MEASUREMENTS

TABLE 1

Average depth measurements for the non-moisture conditioned samples

| n = 84 | $\bar{X}$ | Stan Dev | t-test |
|---|---|---|---|
| NTC 2806-6 | 177 | 24 | — |
| 2806-7 | 157 | 26 | 5.08 |
| CAMAS 91 | 156 | 27 | 5.37 |
| 40 | 170 | 26 | 1.83 |
| 34 | 194 | 40 | 3.38 |
| Apron Dried | 227 | 37 | 10.47 |
| Papan Buckram | 68 | 13 | 36.17 |

A t-test value greater than two is considered to show a significant difference, not caused by chance, between populations.

$$\text{The t-test value} = \frac{\overline{X_1} - \overline{X_2}}{\sqrt{\frac{(SD_1)^2}{n_1} + \frac{(SD_2)^2}{n_2}}}$$

wherein $\overline{X}$ is the mean of n measurements and SD is the standard deviation.

Apron dried samples are taken directly from the fabric and then air dried. Apron dried samples have a greater depth average than drier dried samples.

TABLE 2

| | Grain depth retention measurements | | | | |
|---|---|---|---|---|---|
| | Normal | | Wetted | | |
| | $\overline{X}$ | Stan Dev | $\overline{X}$ | Stan Dev | t-test |
| NTC 2806-6 | 177.0 | 24.34 | 170.10 | 18.20 | 1.80 |
| Papan Buckram | 68.18 | 13.04 | 47.00 | 11.92 | 9.12 |

For the wetted samples, n=42. With water and pressure exposure, NTC 2806-6 retains grain depth whereas Papan Buckram does not (a t-test value of 1.80 indicates very little difference while 9.12 indicates a great deal of difference).

As revealed in Table 2, using mean figures, sample 2806-6 retained 96 percent of its grain depth (170÷177) while Papan retained only 69 percent of its grain depth (47÷68). Accordingly, Sample 2806-6 has a memory factor of 96, and Papan has a memory factor of 69.

Using two standard deviations above the mean, sample 2806-6 retained about 92 percent of its gain depth (206÷225) while Papan retained about 76 percent (71÷94). Using two standard deviations below the mean, sample 2806-6 retained about 104 percent (134÷129) while Papan retained 55 percent (23÷42). Accordingly, the product of the invention will exhibit a memory factor greater than about 80.

TABLE 3

| | Top valley and bottom valley lateral measurements | | | | |
|---|---|---|---|---|---|
| | TOP | | BOTTOM | | CORRELATION |
| | $\overline{X}$ | SD | $\overline{X}$ | SD | Coef. |
| 2806-6 | 420 | 37 | 157 | 16 | .269 |
| CAMAS 91 | 441 | 69 | 186 | 50 | .623 |
| CAMAS 34 | 402 | 105 | 155 | 73 | .764 |

F-value top = 2.76 = .068 probability
bottom = 4.69 = .001 probability

Sample 2806-6 was dried on a Yankee dryer while all the others (unless noted) were dried on conventional steam can dryers.

Some of the statistical tests used to quantify the topographical characteristics included a t-test, a one way analysis of variance (an f-test), and a correlation test. The significance of the t-test was to determine how different two populations are and whether the differences are due to a factor other than chance. The f-test is similar, only it uses the whole population rather than the averages and the standard deviations as in the t-test. It is also an indicator of variation between and within populations. The variation seen in the peak-to-peak measurements is caused by some factor other than chance as indicated by the f-test probability. Lastly, a correlation coefficient was generated in order to determine the relationship between top and bottom valley measurements. There is somewhat of a correlation between top and bottom valley measurements.

The low correlation coefficient found in 2806-6 results from the fact that measurements for 2806-6 are located in a small area and measurements on either side of this are unavailable. However, in order to achieve the textile-like appearance, it is desirable to have very little variation and distribution of the measurements. More variation in measurements occurs on sample material that contains scallop, as compared to other samples.

The design of the take-off fabric is one primary determinant of the surface topography of the product. The major components of the fabric design are the style of weave of the fabric, the projected open area of the fabric, the construction (including the number of layers) of the fabric, and the diameter of filament used to construct the fabric.

Additionally, certain process parameters, especially the speed differential and the pressure between the back-up roll, the fabric, and the chrome roll determine, along with the fabric parameters, the final product appearance. Appearance is considered the surface topography, relative orientation of structure depth in MD/CD directions, and consistency of detail in the surface.

Two fabric constructions have been studied to date, the LDDL fabric and the 39480 fabric, both products of Appleton Wire Division of Albany Felt International. The LDDL fabric gives a product that is especially suited to use on three-piece case constructions. The 39480 fabric, on the other hand, is particularly suited to binder covers such as three-ring or other multiple ring or similar covers. Both have the effect of a well-defined textile surface. The LDDL gives a deeper appearing grain depth compared to the 39480 fabric.

Although these two fabrics are the only ones that have been applied in this process, there are many commercially available fabrics that are undoubtedly suitable for use in this process. Also, fabrics could be especially designed to achieve a specific textile effect when used in this process. Moreover, fabrics could be produced to achieve other than a textile appearance, e.g., leather, wood, and construction type appearances (bricks, etc.).

Additionally, normal fabrics could be produced and then subjected to further processing such as patterned embossing or other surface modification to produce a desirable surface pattern on the final product.

While the examples in this specification are limited to the LLDL and the 39480 fabrics, the range of useful possibilities is by no means restricted to these examples. Other possibilities will be apparent, such as earlier outlined, to those skilled in the art.

The primary area of interest is covered by these two fabrics, including the grain depth and MD/CD topography range of these samples, and all possible combinations between these two examples. By extension, the use of higher and lower grain depth ranges is included in this specification as leading to useful product configurations, including end uses other than cover stock application.

In application of the concepts in this specification, there have arisen distortions of the textile-like surface. Normally, these distortions of the textile-like surface are undesirable; however, for certain marketing applications, they may be considered desirable. At present, these distortions are thought to be produced through the use of a pressure nip between back-up roll 50 and smooth-surfaced or chrome roll 40 of about 0.2 inches and wider.

These distortions are termed "scallop" because of their resemblance of the fanshaped shells of the marine mollusk. The fan-shaped depressions disrupt the periodically repeating pattern of the textile. Their presence modifies the surface topography dimensions. For some uses, the aesthetics of the resulting topography may be considered desirable.

Surface topography on the LDDL prepared samples has the following characteristics. The long axis of the valleys runs in the cross-machine direction; the short axis of the valleys is aligned on a bias offset about 45 degrees from the MD. Valleys are all approximately the same size and are closed on both ends. The width of the valleys and the width of the ridges between valleys are approximately equal.

Figure 20:
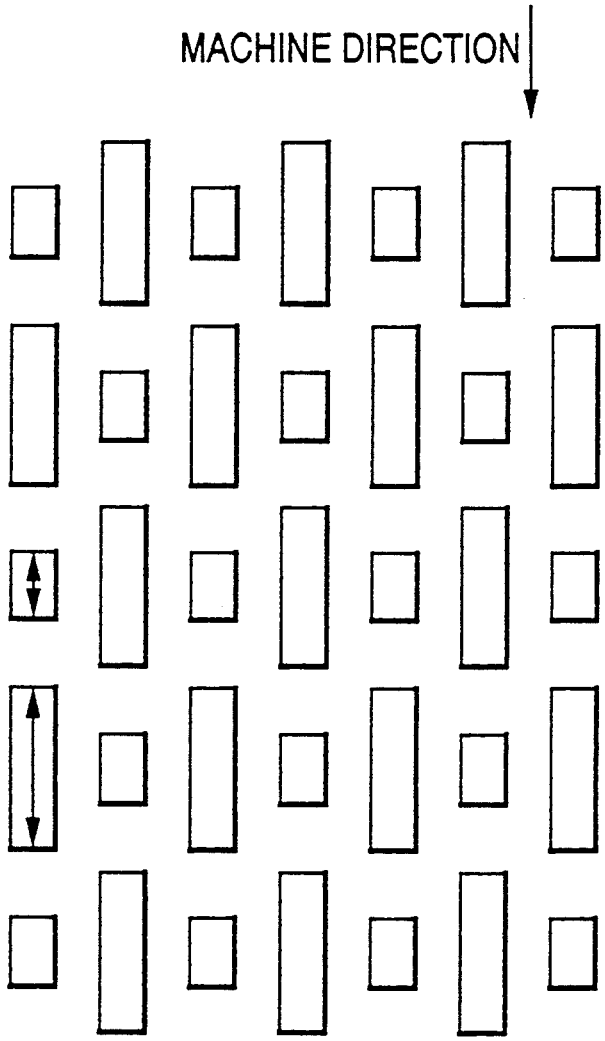
FIG. 20 is a schematic representation of the depressions or valleys in the product of the invention.
Figure 21:
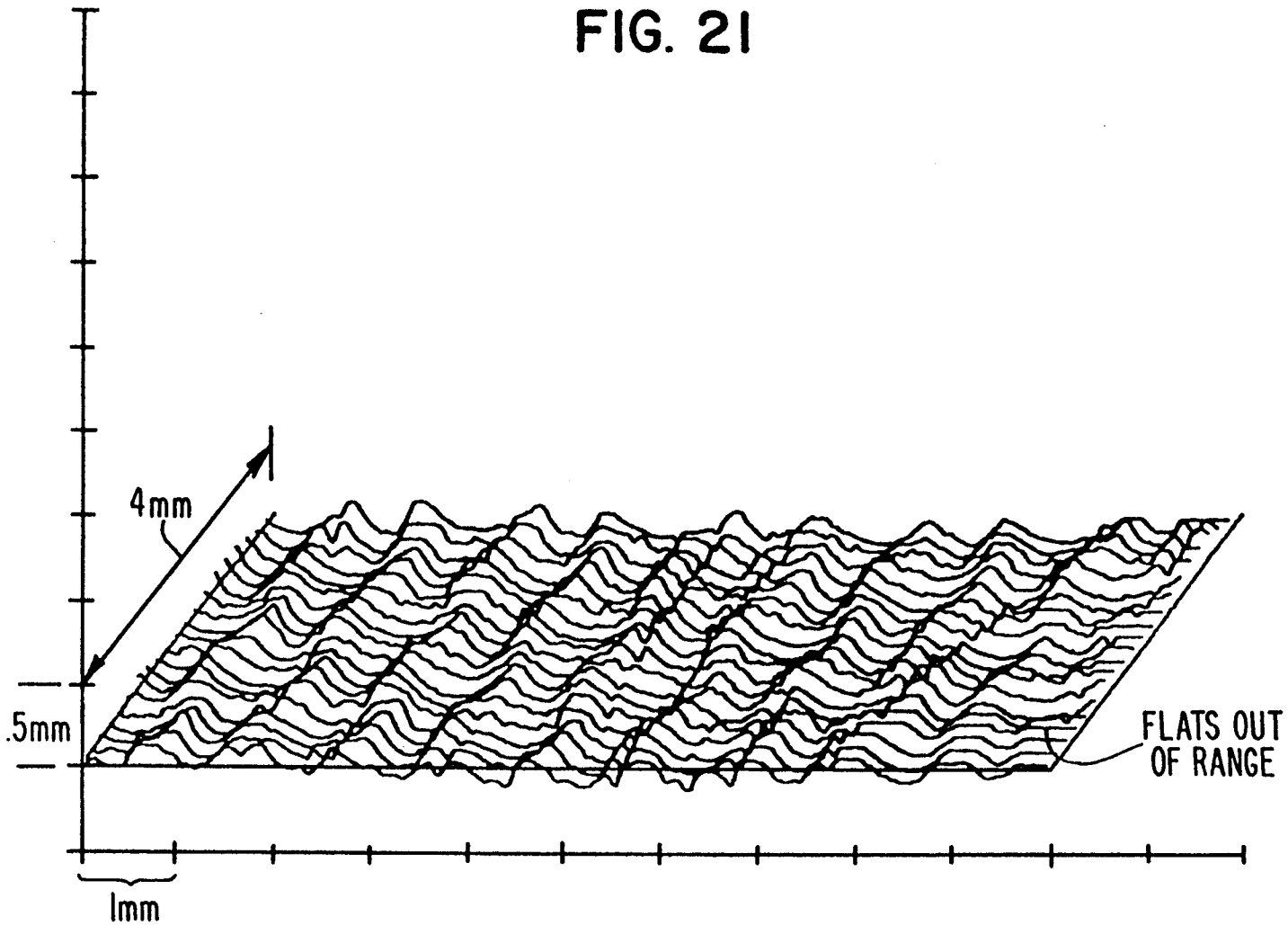
FIGS. 21–27 are profilemeter representations of the product of the invention.
Figure 22:
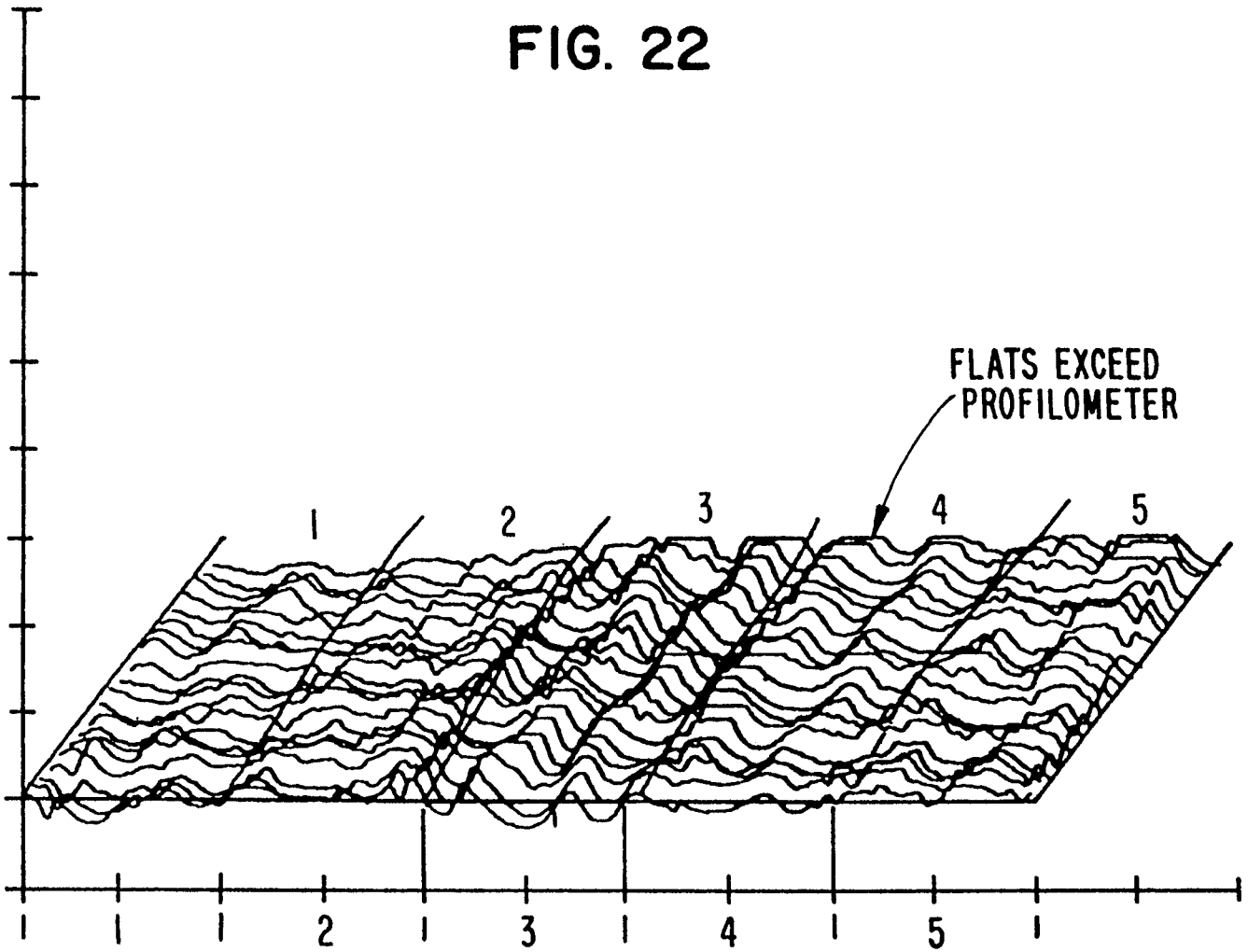
Figure 23:
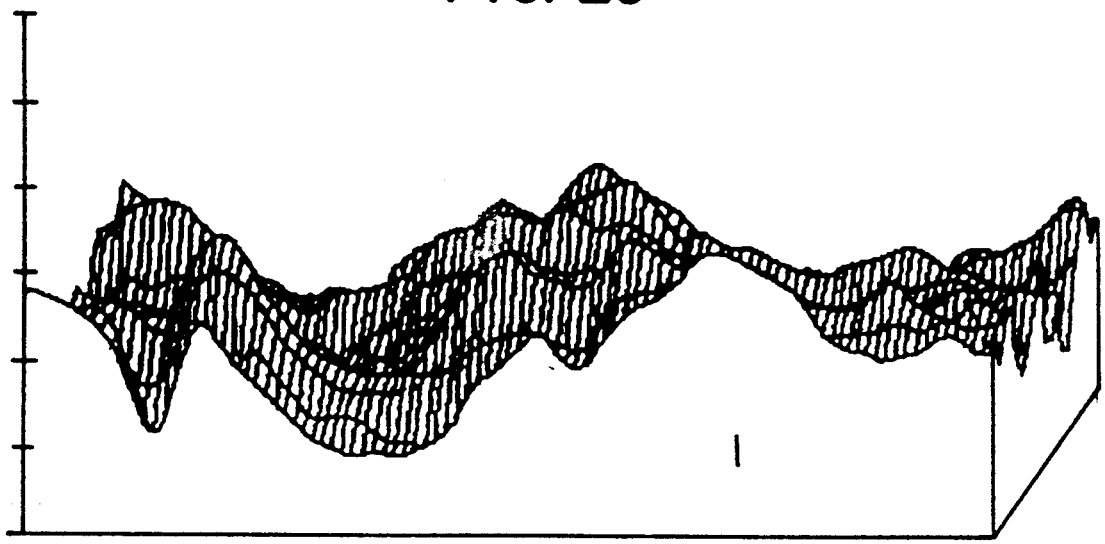
Figure 24:
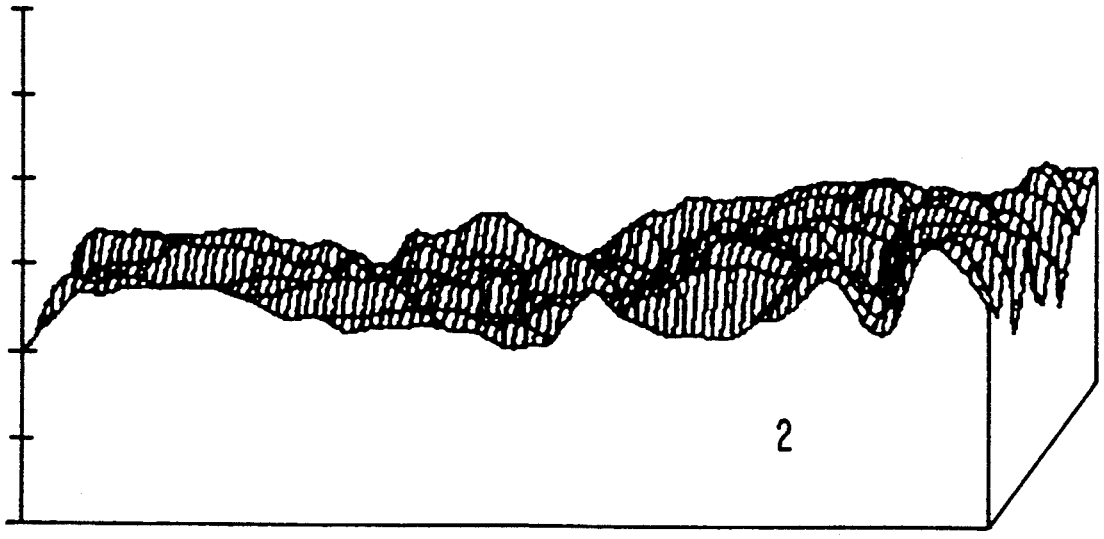
Figure 25:
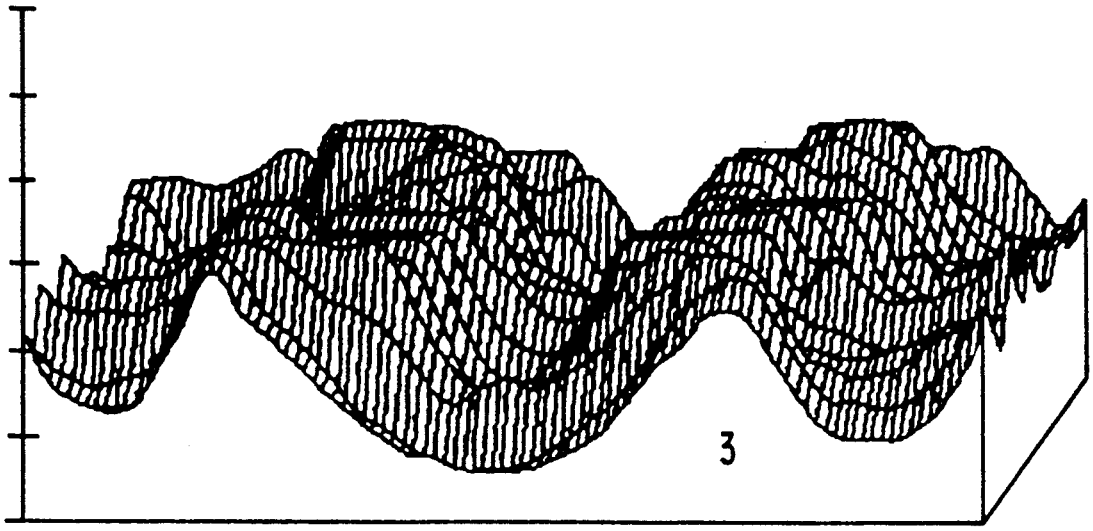
Figure 26:
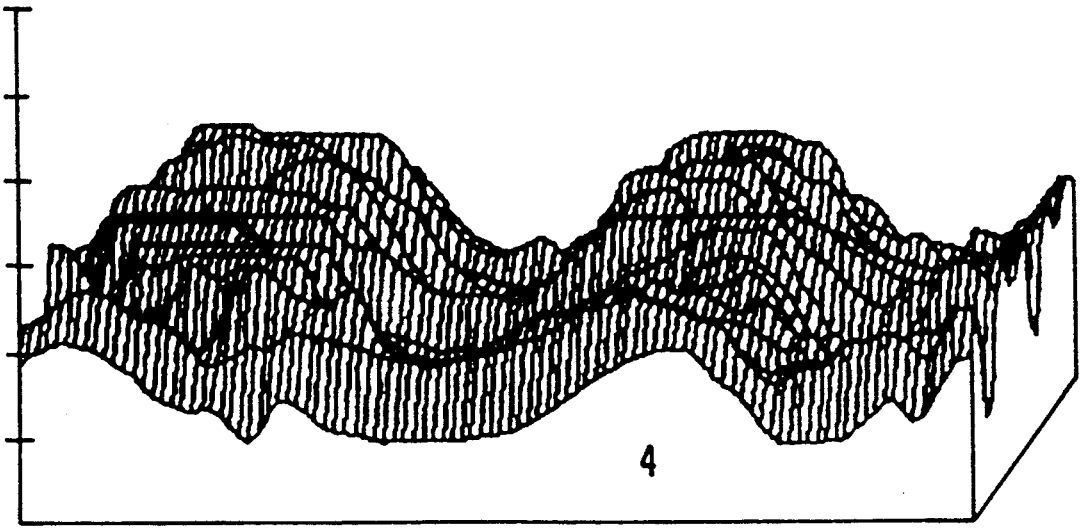
Figure 27:
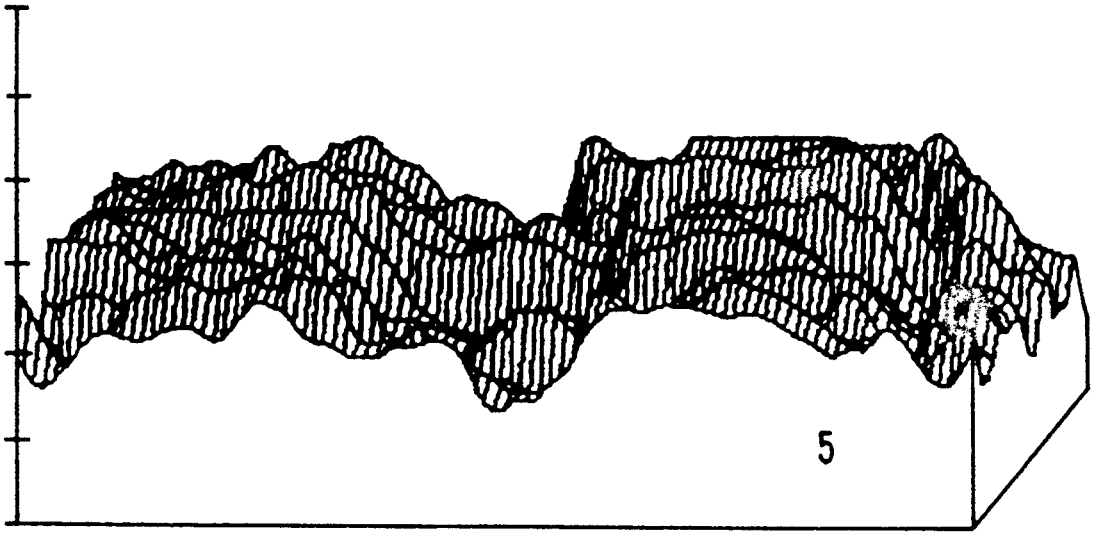

Surface topography on the 39480 prepared product intended for the binder cover market has the following characteristics:

1. The surface is composed of a series of depressions aligned in the machine and cross-machine directions.
2. The depressions shown as squares and rectangles in FIG. 20 are made by a fabric loop that alternates in each direction; that is, in both directions, the orientation of the resulting rectangular depression alternates over a trace of the surface.
3. The ridges resulting on the edges of these depressions are higher in the cross-machine direction than in the machine direction. This is because the differential speed between the chrome roll and fabric over-feeds fiber into the fabric in one direction only.

One effect of scalloping is illustrated in the histograms of FIGS. 21-32 showing an evaluation of two samples.

"Part number: 6" is #6 CAMAS, considered to be heavily scalloped, and "Part number: 50" is #50 CAMAS, considered to have fairly good grain depth and pattern retention.

The principal difference between the samples is increased variation of measurements in sample #6.

The pattern achieved in the histogram for #6 and #50 CAMAS DWE, CMD TVM (FIGS. 29 and 30) can be better understood by referring to FIG. 20. Two sizes of valleys or depressions were being measured. Each has its own range of distances (or top valley measurements).

In Table 4, paper cover stock sheets having textured surfaces are compared with conventional textured paper cover stock samples. Samples A and B are product samples produced according to the present invention. Samples C and D are conventional cover stock having surfaces that are textured off-machine. Both samples C and D are produced and sold by James River Graphics, Inc. of South Hadley, Mass. The unique balance of physical characteristics in the product of the present invention can be seen when this product is compared with the conventional textured paper cover stock samples in columns C and D of Table 4.

Table 5 summarizes the results of further tests of the product and method of the invention.

As indicated above, the second surface of the product is substantially smooth. Smoothness was measured using TAPPI Useful Method No. 535, "Smoothness of Paper and Paperboard (Bendtsen Tester),"0 which is a measurement of airflow per unit time through an orifice. A higher measurement indicates greater airflow, hence a rougher surface. Three samples of the product of the invention were tested; from each sample, five readings were taken and averaged. The units of measure were milliliters per minute. A 75 mm orifice was used. The following results were obtained.

| Sample | Value |
|---|---|
| NTC 2806-6 | 2040 mls/min |
| CAMAS 12/11/87 #36 | 5160 mls/min |
| CAMAS 12/11/87 #37 | 5232 mls/min |

These values generally indicate the range embraced by the term "substantially smooth" as the term pertains to the surface of the product of the invention.

It will be apparent to those skilled in the art that various modifications and variations may be made to the product and the method of the invention without departing from the scope or the spirit of the invention.

TABLE 4

| CHARACTERISTIC | A (2710-3) | B (2748-2) | C KIVAR 6 (Homespun) | D PAPAN (Homespun) |
|---|---|---|---|---|
| Speed Differential, % | 18 | 15 | NA | NA |
| Nip Pressure, PLI | 17 | 13 | NA | NA |
| Nip Pressure, Average PSI | 70 | 50 | NA | NA |
| Furnish | 100% bleached soft wood kraft | 100% unbleached soft wood kraft | 100% bleached soft wood kraft | 100% unbleached soft wood kraft |
| Colored | No | Yes | No | Yes |
| Basis Weight, lb/3000 $ft^2$ | 67.8 | 67.5 | 86.6 | 68.4 |
| Caliper, .001 in | 12.9 | 11.7 | 6.5 | 6.0 |
| Apparent Bulk, cal. pts./lb ream | .19 | .17 | .08 | .09 |
| Apparent Density $\frac{\text{lb ream}}{\text{cal. pt.}}$ | 5.3 | 5.8 | 13.3 | 11.4 |
| Tensile MD, lb/in | 20.9 | 18.5 | 49 | 53 |
| Tensile, CD, lb/in | 27.6 | 23.1 | 30 | 32 |
| Elongation MD, % | 14.7 | 21.7 | 2.5 | 1.8 |
| Elongation CD, % | 5.4 | 2.2 | 4.9 | 3.8 |
| Tensile Energy Absorption MD, in/lb | 9.3 | 9.4 | 4.0 | 2.8 |
| Tensile Energy Absorption CD, in/lb | 3.8 | 1.8 | 5.3 | 5.7 |
| Taber Stiffness MD | 2.9 | 1.9 | 10.0 | 10.0 |
| Taber Stiffness CD | 7.1 | 12.0 | 5.3 | 5.7 |
| MIT Double Folds MD | 2032 | 2318 | 338 | 630 |
| MIT Double Folds CD | 1069 | 593 | 237 | 591 |

TABLE 4-continued

| CHARACTERISTIC | A (2710-3) | B (2748-2) | C KIVAR 6 (Homespun) | D PAPAN (Homespun) |
|---|---|---|---|---|
| Tear MD, grams | 250 | 218 | 106 | 114 |
| Tear CD, grams | 250 | 225 | 113 | 120 |
| Z-Direction Tensile, PSI | 85 | 78 | 107 | 75 |
| Mullen, Points | 66 | 42 | 64 | 56 |

TABLE 5

Trial Date: 1/15/88 2/5/88 DWE - CAMAS TRIAL PHYSICALS Mar-1, 1988 BOOKCOVER

| Sample # | **Fur. | S | Temp (F.) | Solids/ Pressure | B.U. Press | *Roll Dia. | B.W. (lb/k) | Cal. (.001) | Por. (100 s) | Tensile (lb/ia) MD | Tensile (lb/ia) CD | ELongation (Z) MD | ELongation (Z) CD | Comments |
|---|---|---|---|---|---|---|---|---|---|---|---|---|---|---|
| 2 (25-2:47) | 100%/P6 | 28 | 200 | 35.9/60 | 35/40 | 12 | 69 | 11.6 | 7.6 | 22 | 15 | 10.5 | 2.9 | Control, Maroon, Alua 3.75, Regular additives except retention aid |
| 3 (25-3:29) | 90/10 | 28 | 205 | 35.8/60 | 35/40 | 12 | 74 | 12.2 | 9.2 | 19 | 15 | 15.0 | 3.0 | Add 10% Cotton |
| 6 (25-4:07) | 96/10 | 0 | 200 | 38.5/60 | 0 | 12 | 65 | 7.7 | 34.2 | 37 | 18 | 1.2 | 2.5 | No BWE Flat Sht |
| 9 (126-10:21) | 90/10 | 28 | 188 | 37.0/60 | 35/40 | 12 | 75 | 11.7 | 8.4 | 16 | 15 | 11.6 | 2.9 | Lower Alua (1.75 vs 3.75) than #3 |
| 15 427-10:30) | 90/10 | 27 | 200 | 33.2/60 | 55/60 | 12 | 70 | 11.2 | 6.6 | 24 | 18 | 12.4 | 3.6 | Parez631 wet strength, Optimize furnish Alua = 2.6%, Size = .6%, 631 = 7% Scallops acceptable, Roll redried for sizing. |
| 17 (27-12:06) | 90/10 | 28 | 178 | 32.6/60 | 55/60 | 12 | 78 | 11.2 | 11.6 | 23 | 20 | 12.3 | 4.1 | Same as 15 except 0.1% 631 spray, Scallops improved down to acceptable level but definition somewhat lacking? |
| 19 (28-12:50) | 90/10 | 27 | 190 | 32.8;60 | 55/60 | 12 | 74 | 10.7 | 11.6 | 25 | 17 | 9.1 | 4.1 | 0.2% Rezosol spray (as good or perhaps a little better than #17) |
| 20 (27-12:56) | 50/10 | 27 | 170 | —/60 | 55/60 | 12 | 83 | 11.5 | 17.8 | 24 | 18 | 9.7 | 4.1 | Narrow Deckel, weight same as #19 |
| 22 (27-2:28) | 90/10 | 27 | 185 | 36.0/60 | 55/60 | 12 | 72 | 10.8 | 8.8 | 24 | 17 | 9.3 | 3.9 | 0.2% Houghton 585 release |
| 23 (27-4:36) | 90/10 | 28 | 185 | 32.8/60 | 60/65 | 8 | 73 | 10.9 | 7.6 | 22 | 18 | 7.9 | 3.5 | Improved (scallops acceptable) Roll was redried for sizing. |
| 25 (28-9:49) | 90/10 | 27 | 185 | 43.3/60 | 65/60 | 8 | 84 | 12.2 | 6.8 | 23 | 17 | 8.7 | 3.7 | Narrow Deckel essentially so scallops. |
| 46 (3-12:34) | 90/10 | 25 | 155 | 33.6/60 | 55/60 | 8 | 68 | 10.5 | 14.1 | 31 | 21 | 11.1 | 4.5 | Low tension-Low temp, New fabric |
| 47 (3-12:44) | 90/10 | 25 | 185 | 34.6/60 | 55/60 | 8 | 68 | 10.2 | 13.0 | 30 | 20 | 10.6 | 3.9 | Regular tension and temperature. |
| 48 (3-12:55) | 90/10 | 26 | 185 | 36.6/60 | 55/60 | 8 | 70 | 10.3 | 8.2 | 29 | 19 | 10.8 | 3.9 | Low tension, Regular temp. |
| 49 (3-1:13) | 90/10 | 25 | 170 | 34.4/60 | 55/60 | 8 | 72 | 11.3 | 15.8 | 31 | 21 | 12.5 | 5.3 | Good definition |
| 50 (3-1:33) | 90/10 | 25 | 180 | 31.4/60 | 55/60 | 8 | 69 | 10.5 | 17.7 | 30 | 21 | 9.8 | 4.3 | Spray Parez 631 @ 0.1%, little improvement. |
| 51 (3-1:49) | 90/10 | 25 | 185 | 32.3/60 | 55/60 | 8 | 74 | 10.8 | 17.1 | 32 | 22 | 12.5 | 5.4 | 0.2% Parez, low tension, regular temp. |
| 52 (3-2:01) | 90/10 | 25 | 190 | —/80 | 55/60 | 8 | 66 | 9.1 | 9.8 | 33 | 20 | 6.8 | 4.6 | 0.2% Parez, low tensions, regular temp. |
| 53 (3-/—) | 90/10 | 25 | 190 | —/80 | 55/60 | 8 | 82 | 10.3 | 17.6 | 37 | 23 | 6.0 | 5.6 | Same as above with narrow 10" web. |
| 54 (4-11:06) | 90/10 | 24 | 180 | 44,3/75 | 60/65 | 8 | 75 | 11.9 | 8.8 | 30 | 20 | 20.0 | 4.7 | Reduced open draw in 1st dryer. (70 fps) |

TABLE 5-continued

| | | | | | | | | | | | | | | |
|---|---|---|---|---|---|---|---|---|---|---|---|---|---|---|
| 59 (4-1:30) | 89/16 | 185 | 35.5/75 | 80/65 | 8 | 64 | 9.9 | 9.6 | 29 | 20 | 13.4 | 5.3 | | |
| 60 (14-2:55) | 94/10 | 20 | 190 | 54.3/75 | 60/65 | 8 | 75 | 11.9 | 6.6 | 29 | 19 | 17.2 | 3.3 | Transfered to Yankee dryer |

*DWE Back-up Roll
All Drying with Cans
**Furnish Key:
100/PG = PRINCE GEORGE WEL, FULL CHEMICALS (ALUM, SIZE AND WET STRENGTH ADDITIVE)
NO RETENTION AID
90/10 = 90% PRINCE GEORGE WEL/10% COTTON
6. RAMICH Trial Date-2/2≧2/4/88 SUMMARY OF CAMAS BOOKCOVER SIZE PRESS TRIAL
Mar-1, 1988

| Sample # | B.W. (lb/rm) | Cal (.001) | Tensile (lb/in) MD | Tensile (lb/in) CD | % Stretch MD | % Stretch CD | AIR-RESIST (100 S) | SPEED (PPM) | PRESSURE (psig) | STARCH (% PickUp) | FORMULA # | STARCH (Temp) |
|---|---|---|---|---|---|---|---|---|---|---|---|---|
| *PR 16 | 81 | 11.8 | 23 | 20 | 11. | 3.9 | 10 | | | | #1 | |
| *SP 3 | 76 | 10.5 | 31 | 28 | 7.8 | 2.8 | 11 | 60 | 30/30 | 4.56 | Pen-Gum | 154 |
| % Change | +6.2 | −11 | +35 | +29 | 32 | 28 | −11 | | | | 280 | |
| PR 23 | 73 | 10.9 | 22 | 18 | 7.9 | 3.5 | 8 | | | | #1 | |
| SP 4 | 77 | 10.1 | 33 | 27 | 5.4 | 2.9 | 17 | 60 | 30/30 | 3.32 | Pen-Gum | 154 |
| % Change | +5.2 | −7.3 | +33 | +33 | −32 | −17 | −55 | | | | 200 | |
| PR 15 | 70 | 11.2 | 24 | 18 | 12. | 3.6 | 7 | | | | #1 | |
| SP 5 | 74 | 10 | 33 | 26 | 9.1 | 2.5 | 10 | 60 | 30/30 | 5.7 | Pen-Gum | 156 |
| % Change | +5.4 | −10.7 | +29 | +31 | −27 | −31 | −37 | | | Dry Basis | 280 | |
| PR 15 | 70 | 11.2 | 24 | 18 | 12. | 3.6 | 7 | | | | #2 | |
| SP 6 | 75 | 10.4 | 33 | 29 | 7.8 | 2.8 | 11 | 60 | 30/30 | 5.8/ | x-linker | 148 |
| % Change | +6.7 | −7.1 | +27 | +30 | −37 | −22 | −42 | | | | Parez 613 catalyst | |
| PR 23 | 73 | 10.9 | 22 | 18 | 7.9 | 3.5 | 8 | | | | #2 | |
| SP 7 | 76 | 10.2 | 35 | 27 | 5.7 | 3 | 17 | 60 | 30/30 | 3.87 | x-linker | 132 |
| % Change | +3.9 | −6.4 | +37 | +24 | −28 | −14 | −55 | | | | Parez 613 catalyst | |
| PR 23 | 73 | 10.9 | 22 | 18 | 7.9 | 3.5 | 8 | | | | #2 | |
| SP 8 | 75 | 10.3 | 28 | 23 | 4.6 | 3.2 | 15 | 60 | 30/30 | 3 | x-linker | 100 |
| % Change | +2.7 | −5.5 | −21 | +22 | −42 | −8.6 | −51 | | | | Parez 613 catalyst | |
| PR 59 | 64 | 9.9 | 29 | 20 | 13. | 5.3 | 10 | | | | #3 | |
| SP 1 | 70 | 9.7 | 38 | 25 | 10. | 4.3 | 23 | 61 | 30/30 | NA | no x link | NA |
| % Change | +8.6 | <2 | +24 | +20 | −19 | −19 | −58 | | | | w/Silcron | |
| PR 59 | 64 | 9.9 | 29 | 20 | 13. | 5.3 | 10 | | | | #3 | |
| SP 2 | 67 | 9.4 | 35 | 23 | 10. | 4.4 | 20 | 61 | 30/30 | 0.62 | no x link | NA |
| % Change | 4.5 | 5.1 | +12 | +13 | −24 | −19 | −53 | | | | w/Silicon | |

*PARENT ROLL #
*SIZE PRESS ROLL #

What is claimed is:

1. A method of manufacturing paper cover stock having a textured surface pattern, comprising the steps of:

(a) forming a wet fibrous web;

(b) partially dewatering the web to between about 30% and about 60% solids;

(c) conveying the partially dewatered web on a roll rotating at a surface speed to a compression nip defined by the roll and a fabric material having a textured surface pattern;

(d) moving said fabric material at a speed of about 10% to about 40% less than the surface speed of said roll;

(e) compressing said web in said nip by forcing said fabric material against said web on said roll to directly transfer said web from said roll to said fabric material, said fabric material being compressed against said web with a compression force of at least about 5 lbs/linear inch, the average pressure in the compression nip being at least about 20 psi, said fabric material imprinting a textured pattern on a surface of said web, said web being further compressed and textured by the difference in speed between said fabric material and the surface of said roll; and (f) drying said web, said dried web having an apparent density greater than about 4 lb ream/caliper pt. in mils.

2. The method of claim 1 including the step of imparting to the web a memory factor greater than about 80.

3. The method of claim 1 wherein the step of moving the fabric material includes subjecting the fabric material to a tension on opposite sides of the compression nip, the tension on the fabric material entering said nip being greater than the tension on the fabric material exiting said nip.

4. The method of claim 1 including the step of applying a vacuum through said fabric material at said compression nip to directly transfer said web from said roll to said fabric material and to generally conform the surface of said web in contact with said fabric material to the textured surface pattern of said fabric material.

5. The method of claim 1 wherein the step of compressing said web includes using an average compression pressure in said nip between about 20 psi and about 400 psi.

6. The method of claim 1 wherein the step of compressing said web includes heating said web to a temperature achieved by heating said roll to about 150° to about 210° F.

7. The method of claim 1 further comprising the step of applying a protective coating to the web.

8. The method of claim 1 wherein the conveying step is accomplished by a roll having a surface roughness average value of from about 0.5 microinches to about 125 microinches.

* * * * *